US006505359B2

(12) United States Patent
Heimbrock et al.

(10) Patent No.: US 6,505,359 B2
(45) **Date of Patent: *Jan. 14, 2003**

(54) STRETCHER CENTER WHEEL MECHANISM

(75) Inventors: Richard H. Heimbrock, Cincinnati, OH (US); William K. Moore, Batavia, OH (US); Donald E. Smith, Greensburg, IN (US); William M. Blyshak, Milan, IN (US); Joanthan T. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/905,084

(22) Filed: Jul. 13, 2001

(65) Prior Publication Data

US 2001/0039679 A1 Nov. 15, 2001

Related U.S. Application Data

(63) Continuation of application No. 09/481,259, filed on Jan. 11, 2000, now Pat. No. 6,286,165, which is a continuation of application No. 09/150,917, filed on Sep. 10, 1998, now Pat. No. 6,016,580, which is a continuation of application No. 08/631,585, filed on Apr. 12, 1996, now Pat. No. 5,806,111.

(51) Int. Cl.[7] ..... A61G 1/02

(52) U.S. Cl. ..... 5/86.1; 5/600; 280/43.17; 280/98; 280/764.1

(58) Field of Search ..... 5/600, 86.1; 280/43.17, 280/43, 86.5, 98, 764.1, 767; 16/19, 34, 35, 32

(56) References Cited

U.S. PATENT DOCUMENTS

| | | | |
|---|---|---|---|
| 813,213 | A | 2/1906 | Johnson |
| 934,949 | A | 9/1909 | Trickey et al. |
| 1,102,153 | A | 6/1914 | Jurgens |
| 1,110,838 | A | 9/1914 | Taylor |

(List continued on next page.)

FOREIGN PATENT DOCUMENTS

| | | |
|---|---|---|
| CA | 731839 | 4/1966 |
| CA | 2010543 | 9/1990 |
| CH | 250239 | 8/1947 |
| DE | DE 43 17 149 A1 | 11/1993 |
| DE | DE 43 19 516 C2 | 12/1994 |
| DE | 295 18 502 | 1/1997 |
| DE | 199 21 503 | 4/2000 |
| EP | 0 093 700 | 11/1980 |
| EP | 0 062 180 A2 | 10/1982 |
| EP | 0 329 504 B1 | 8/1989 |

(List continued on next page.)

OTHER PUBLICATIONS

"Renaissance Series Head & Neck Surgery Model 1068", Stryker Patient Handling Brochure, Sep. 1993.*
Stryker Corp. "Advantage Series Trauma Stretcher Model 1002", brochure, Sep. 1993.*

(List continued on next page.)

*Primary Examiner*—Michael F. Trettel
(74) *Attorney, Agent, or Firm*—Barnes & Thornburg

(57) ABSTRACT

A stretcher for transporting a patient along a floor includes an elongated frame, a patient-support deck carried by the frame, and an elongated shaft having a longitudinally-extending axis of rotation. The shaft is coupled to the frame for rotation about the axis of rotation between a first orientation and a second orientation. The stretcher also includes a wheel supported relative to the frame and movable relative to the frame in response to rotation of the shaft. The wheel is in a first position engaging the floor when the shaft is in the first orientation and the wheel is in a second position spaced apart from the floor when the shaft is in the second orientation.

10 Claims, 9 Drawing Sheets

U.S. PATENT DOCUMENTS 1,118,931 A 12/1914 Hasley
1,270,383 A 6/1918 Crawford
1,322,788 A 11/1919 Hazelton
1,483,607 A 2/1924 Liedtke
1,598,124 A 8/1926 Evans
2,224,087 A 12/1940 Reichert
2,295,006 A 9/1942 Philips
2,563,919 A 8/1951 Christensen
2,599,717 A 6/1952 Menzies
2,635,899 A 4/1953 Osbon, Jr.
2,935,331 A 5/1960 Ledgerwood
2,999,555 A 9/1961 Stroud et al.
3,112,001 A 11/1963 Wise
3,269,744 A 8/1966 Dobson
3,304,116 A * 2/1967 Stryker ..... 5/86.1
3,305,876 A 2/1967 Hutt
3,380,546 A 4/1968 Rabjohn
3,393,004 A 7/1968 Williams
3,452,371 A 7/1969 Hirsch
3,544,127 A 12/1970 Dobson
3,618,966 A 11/1971 Vandervest
3,680,880 A 8/1972 Blaauw
3,814,199 A 6/1974 Jones
3,820,838 A 6/1974 Limpach
3,829,116 A 8/1974 Burdick
3,831,210 A 8/1974 Ow
3,876,024 A 4/1975 Shieman et al.
4,137,984 A 2/1979 Jennings et al.
4,164,355 A 8/1979 Eaton et al.
4,175,783 A 11/1979 Pioth
4,178,005 A 12/1979 Kent, Jr.
4,190,280 A 2/1980 Donohoe
4,274,503 A 6/1981 Mackintosh
4,415,049 A 11/1983 Wereb
4,417,738 A 11/1983 Kendall
4,439,879 A * 4/1984 Werner ..... 5/86.1
4,475,611 A 10/1984 Fisher
4,475,613 A 10/1984 Walker
4,566,707 A 1/1986 Nitzberg
4,579,381 A 4/1986 Williams
4,584,989 A 4/1986 Stith
4,629,242 A 12/1986 Schrager
4,723,808 A 2/1988 Hines
4,724,555 A 2/1988 Poehner et al.
4,759,418 A 7/1988 Forster
4,811,988 A 3/1989 Immel
4,921,262 A 5/1990 Svitak
4,922,574 A 5/1990 Heiligenthal et al.
4,979,582 A 12/1990 Forster
4,981,309 A 1/1991 Froschle et al.
5,060,327 A 10/1991 Celestina et al.
5,060,959 A 10/1991 Davis et al.
5,069,465 A 12/1991 Stryker et al.
5,083,625 A 1/1992 Bleicher
5,084,922 A 2/1992 Louit
5,094,314 A 3/1992 Hayata
5,121,806 A 6/1992 Johnson
5,156,226 A 10/1992 Boyer et al.
5,158,319 A 10/1992 Norcia et al.
5,187,824 A 2/1993 Stryker
5,201,819 A 4/1993 Shiraishi et al.
5,279,010 A 1/1994 Ferrand et al.
5,293,950 A 3/1994 Marliac
5,308,094 A 5/1994 McWhorter et al.
5,337,845 A 8/1994 Foster et al.
5,348,326 A * 9/1994 Fullenkamp et al. .... 280/43.17
5,358,265 A 10/1994 Yaple
5,377,370 A 1/1995 Foster et al.
5,377,372 A * 1/1995 Rudolf et al. ..... 5/600
5,388,294 A 2/1995 Reeder
5,402,543 A * 4/1995 Dietrich et al. ..... 5/610
5,447,317 A 9/1995 Gehlsen et al.
5,477,935 A 12/1995 Chen
5,495,904 A 3/1996 Zwaan et al.
5,526,890 A 6/1996 Kadowaki
5,535,465 A 7/1996 Hannant
4,763,910 A 8/1998 Brandli et al.
5,806,111 A 9/1998 Heimbrock et al.
5,937,961 A 8/1999 Davidson
5,944,131 A 8/1999 Schaffner et al.
5,964,313 A 10/1999 Guy
5,964,473 A 10/1999 Degonda et al.
5,971,091 A 10/1999 Kamen et al.
5,987,671 A 11/1999 Heimbrock et al.
5,988,304 A 11/1999 Behrendts
5,996,149 A 12/1999 Heimbrock et al.
6,016,580 A 1/2000 Heimbrock et al.
6,035,561 A 3/2000 Paytas et al.
6,050,356 A 4/2000 Takeda et al.
6,076,208 A 6/2000 Heimbrock et al.
6,256,812 B1 * 7/2001 Bartow et al. ..... 5/86.1
6,264,006 B1 * 7/2001 Hanson et al. ..... 5/86.1
6,286,165 B1 * 9/2001 Heimbrock et al. ..... 5/86.1

FOREIGN PATENT DOCUMENTS

EP 0 352 647 B1 1/1990
EP 0 403 202 B1 12/1990
EP 0 420 263 4/1991
EP 0 630 637 12/1994
EP 0 653 341 A1 5/1995
EP 0 776 637 6/1997
FR 2 236 481 9/1973
GB 415450 8/1934
GB 2 285 393 7/1995
JP 46-31490 9/1971
JP 47-814 8/1972
JP 47-17495 10/1972
JP 47-44792 6/1973
JP 48-44793 6/1973
JP 48-54494 7/1973
JP 48-54495 7/1973
JP 49-29855 8/1974
JP 51-20491 2/1976
JP 53-9091 1/1978
JP 53-96397 8/1978
JP 56-68523 6/1981
JP 56-68524 6/1981
JP 56-73822 6/1981
JP 57-157325 10/1982
JP 57-187521 11/1982
JP 59-38176 4/1983
JP 58-63575 3/1984
JP 59-37946 3/1984
JP 59-183756 10/1984
JP 59-186554 10/1984
JP 9-24071 1/1985
JP 60-12058 1/1985
JP 60-12059 1/1985
JP 60-21751 2/1985
JP 60-31749 2/1985
JP 60-31750 2/1985
JP 60-31751 2/1985
JP 60-122561 7/1985
JP 60-188152 9/1985
JP 60-188153 9/1985
JP 61-188727 11/1986
JP 62-60433 4/1987
JP 64-17231 1/1989
JP 2-84961 3/1990
JP 4-108525 9/1992
JP 6-50631 7/1994

| | | |
|---|---|---|
| JP | 6-237959 | 8/1994 |
| JP | 7-136215 | 5/1995 |
| JP | 8-112244 | 5/1996 |
| JP | 8-317953 | 12/1996 |
| JP | 9-38154 | 2/1997 |
| JP | 9-38155 | 2/1997 |
| JP | 10-146364 | 6/1998 |
| JP | 10-181609 | 7/1998 |
| JP | 10-305705 | 11/1998 |
| JP | 2000-107230 | 4/2000 |
| JP | 2000-118407 | 4/2000 |
| JP | 2000-175974 | 6/2000 |
| WO | 82/01313 | 4/1982 |
| WO | WO 87/07830 | 12/1987 |
| WO | 94/16935 | 8/1994 |
| WO | WO 94/21505 | 9/1994 |
| WO | WO 95/20514 | 8/1995 |
| WO | WO 96/07555 | 3/1996 |
| WO | WO 96/33900 | 10/1996 |
| WO | 97/39715 | 10/1997 |
| WO | 00/37222 | 6/2000 |

OTHER PUBLICATIONS

Stryker Corp. "Advanced Patient Transport and Transfer" brochure, Jun. 1994.*

Stryker Corp. "Advantage Stretchers" brochure, May 1994.*

Stryker Medical, "Transport Stretchers", brochure that covers Model 720 and 721, copyright 07/01.*

Stryker Medical, "Stretcher options and accesories", brochure dated May 1998.*

Three photographs taken in Mar., 1996 of the Moduline® stretcher made by Reliance, Inc.

"Extended Stay Model 1550", Stryker® Patient Handling brochure, five pages, Sep. 1993.

"Renaissance Series Head/Neck Surgery Stretcher Model 1067", Stryker® Patient Handling brochure, two pages, Dec. 1992.

Reliance® M–701 Surgical Stretcher, Mobile Surgical Stretcher Koenigkramer Denstply brochure, six pages, date unknown.

Hausted, Inc., "Specialty Stretchers—The Unicare Series", Aug., 1993, 8 pages.

Hausted, Inc., "Introducing A New Generation of Patient Handling Equipment: The Legacy Series", Sep. 1992, 4 pages.

Hausted, Inc., "The Gemini Series" Oct., 1993, 4 pages.

Stryker, "Fluoroscopy Stretcher Model 1075", date unknown, 2 pages.

Stryker, "Specifications Concealacare® Model 978", Jun. 1993, 1 page.

Stryker, "921 Instacare® Trauma/Emergency Department Stretcher Modifications", May 1984, 12 pages.

Stryker, "Renaissance Series 1060 OB/GYN Trauma Bed Maintenance Manual", Mar. 1992, 54 pages.

Photos A–G of a prior art Stryker Model 1001 stretcher with raiseable and lowerable wheel, date unknown.

* cited by examiner

FIG. 4
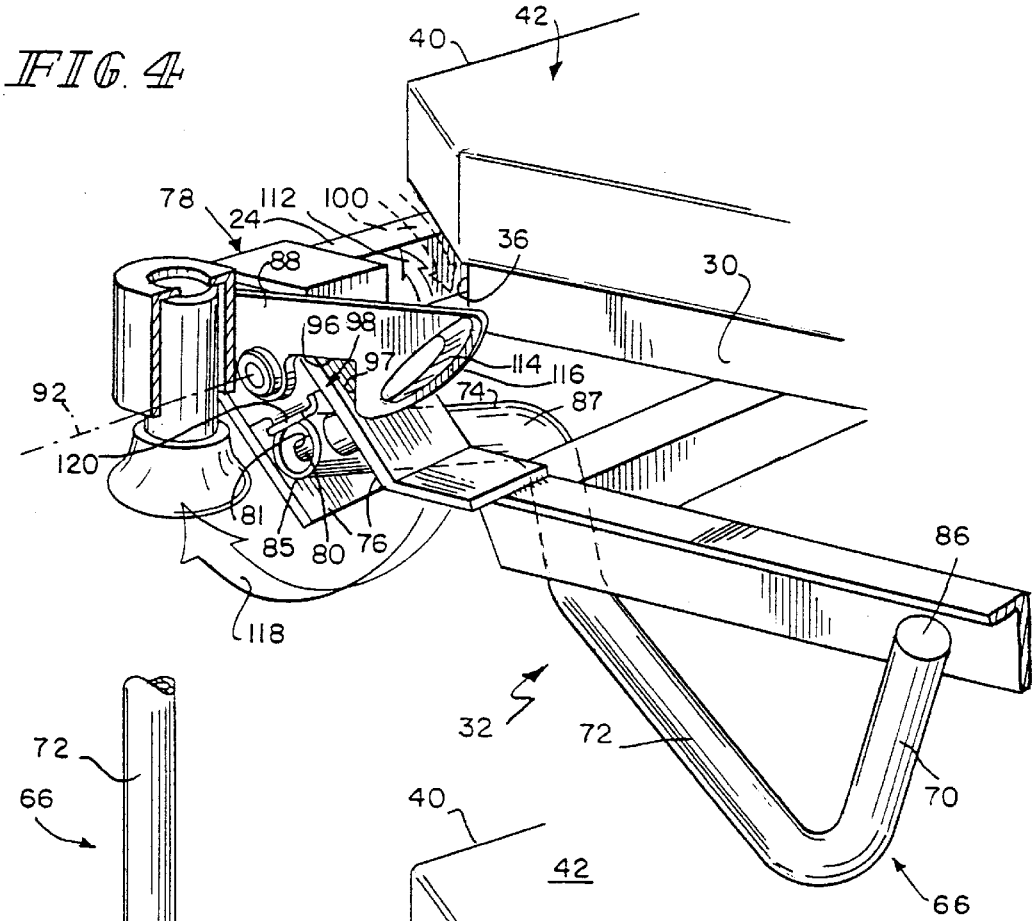
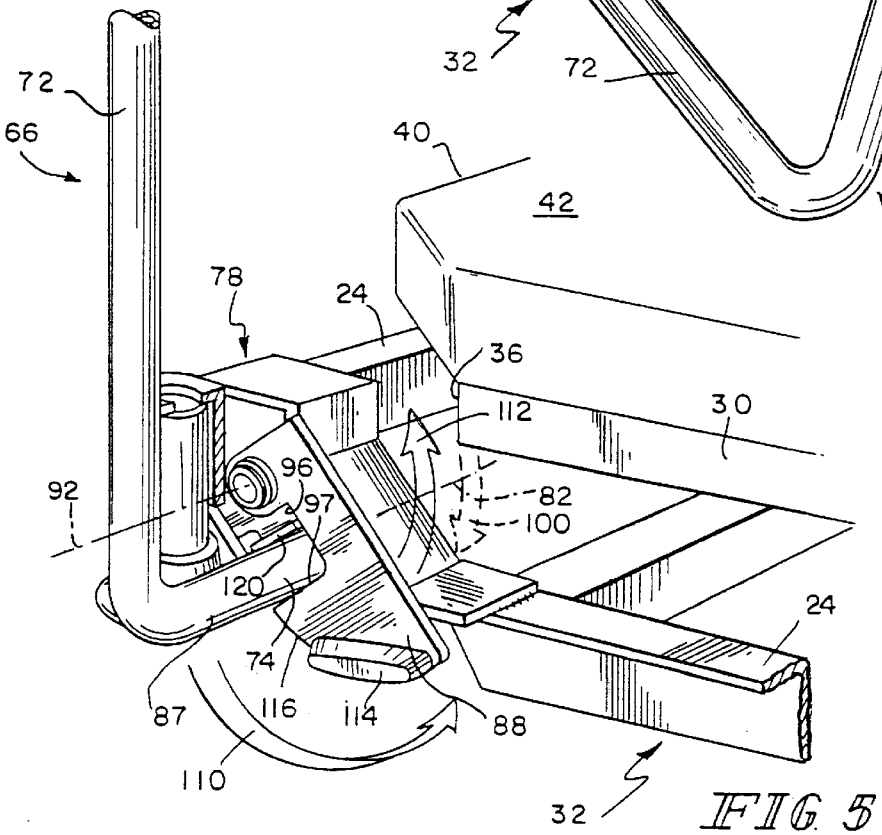
FIG. 5

STRETCHER CENTER WHEEL MECHANISM

This application is a continuation of U.S. application Ser. No. 09/481,259, filed Jan. 11, 2000 now U.S. Pat. No. 6,286,165. U.S. application Ser. No. 09/481.259 is a continuation of U.S. application Ser. No. 09/150,917, filed Sep. 10, 1998, now U.S. Pat. No. 6,016,580. U. S. application Ser. No. 09/150,917 is a continuation of U.S. application Ser. No. 08/631,585, filed Apr. 12, 1996, now U.S. Pat. No. 5,806, 111.

BACKGROUND AND SUMMARY OF THE INVENTION

The present invention relates to a stretcher such as a wheeled stretcher for use in a hospital, and particularly to stretcher controls for the stretcher. More particularly the present invention relates to such a hospital stretcher having stowable push handles, a deployable center wheel to aid in steering the stretcher, foot pedals for tilting and controlling the height of a patient-support deck, and a shroud defining a storage surface underneath the patient-support deck.

Many hospital stretchers include a patient-support deck having a patient-support surface that can be moved upwardly and downwardly and tilted to both a Trendelenburg position having a head end of the patient-support surface lower than a foot end of the patient- support surface and a reverse Trendelenburg position having the head end of the patient-support surface higher than the foot end of the patient-support surface. Hospital stretchers often have foot pedals that a caregiver can engage to adjust the position of the patient-support surface. See, for example, U.S. Pat. No. 4,723,808 to Hines; U.S. Pat. No. 4,629,242 to Schrager; U.S. Pat. No. 4,175,783 to Pioth; and U.S. Pat. No. 3,304, 116 to Stryker. Each of these references discloses a stretcher having at least one foot pedal that is used to control the movement of the patient-support surface.

Some conventional stretchers have two foot pedals positioned to lie close together for controlling movement of the patient-support surface. For example, U.S. Pat. No. 4,723, 808 to Hines discloses a stretcher in which the head end of the patient-support surface is raised by pumping one pedal and the foot end of the patient-support surface is raised by pumping the other pedal. Both ends of the patient-support surface can be raised together by pumping both pedals simultaneously. Each end of the patient-support surface can be lowered separately by pressing the corresponding pedal to the bottom of its stroke and both ends can be lowered together by pressing both pedals to the bottom of their stroke simultaneously.

Conventional hospital stretchers may also include casters that rotate and swivel as well as a center wheel that can be deployed to contact a floor surface over which the stretcher is being pushed. See, for example, U.S. Pat. No. 5,348,326 to Fullenkamp et al. which is assigned to the assignee of the present invention, and U.S. Pat. No. 5,083,625 to Bleicher; U.S. Pat. No. 4,164,355 to Eaton et al.; U.S. Pat. No. 3,304,116 to Stryker; and U.S. Pat. No. 2,599,717 to Menzies. The center wheel is typically free to rotate but is constrained from swiveling in order to facilitate turning the stretcher around corners. Additionally, some stretchers have center wheels that are yieldably biased downwardly against the floor to permit the center wheel to track differences in elevation of the floor.

Stretchers can also be provided with a shroud that is located underneath the patient-support deck and that provides a top surface on which objects can be carried. See, for example, U.S. Pat. No. 5,083,625 to Bleicher. However, the size of the shroud top surface of conventional stretchers having mechanisms operated by foot pedals is typically limited so that a caregiver has access to the foot pedals.

Finally, some conventional stretchers have push handles mounted to an end of an upper frame of the stretcher that can be conveniently gripped by a caregiver moving the stretcher. Push handles that are pivotable between a use position when the caregiver moves the stretcher and a downward storage position are known as well. See; for example, U.S. Pat. No. 5,388,294 to Reeder, which is assigned to the assignee of the present invention, and U.S. Pat. No. 5,069,465 to Stryker et al. Stretchers having a pair of push handles mounted at the head end of the stretcher and pivotable about a pivot axis extending in a direction parallel to the sides of the stretcher are known in the art. Stretchers having pivotable push handles can also include mechanisms for locking the push handles in the push position.

What is desired is a stretcher having push handles that are movable to a push position extending above the patient-support surface and swingable from the push position to a down-out-of-the-way position below the patient-support deck providing a caregiver with improved access to a patient. The stretcher could include a push handle assembly having a latch mechanism underneath the upper frame of the stretcher for locking the push handles in the push position. In addition, caregivers would welcome such a stretcher having a single foot pedal that controls both the deployable center wheel mechanism and the caster braking mechanism as well as a single foot pedal for simultaneously lowering the two ends of the patient-support deck. Finally, the stretcher could include a shroud having a large storage surface underneath the patient-support deck for carrying articles belonging to the patient, medical equipment, or other articles conveniently stored beneath the patient-support deck while also allowing access to the foot pedals positioned beneath the storage surface.

According to the present invention, a stretcher is provided for transporting a patient. The stretcher includes an elongated frame having an upper frame and a lower frame, a plurality of casters mounted to the lower frame, and a patient-support deck supported by the upper frame. The patient-support deck includes a head end, a foot end, two elongated sides, and an upwardly-facing patient-support surface therebetween. A push bar including a handle post that can be gripped by a caregiver when the caregiver pushes the stretcher is pivotably mounted to the upper frame to pivot about a pivot axis. The push bar can pivot between a push position having the handle post extending above the patient-support surface and a down-out-of-the-way position having a portion of the push bar located underneath the upper frame.

In preferred embodiments, the stretcher includes a push bar that swings between a push position above the head end of the patient-support surface and a down-out-of-the-way position away from the patient-support surface and having a portion of the push bar underneath the patient-support deck. The push bar swings about an angled pivot axis positioned to lie near an elongated first side of the patient-support deck. The angled pivot axis is preferably positioned to lie in a transversely extending plane and preferably angles downwardly away from the center of the stretcher. A second push bar can also be pivotably mounted to the patient-support deck near an elongated second side of the patient-support deck, thus providing a pair of opposing push bars that a caregiver can grip while pushing the stretcher.

The stretcher can be provided with first and second latch plates, each of which engages one of the first and second push bars to lock each respective push bar in the push position. Each latch plate is mounted to the stretcher underneath the upper frame and independently pivots about a pivot axis between a lock position and a release position. Each latch plate includes an edge defining an opening receiving the push bar when the push bar is in the push position and the latch plate is in the lock position, the edge including a locking edge engaging the push bar to lock the push bar in the push position. If desired, the latch plate can be pivoted to a release position away from the push bar and releasing the push bar so that the push bar can swing between the push position and the down-out-of-the-way position.

Each latch plate can also include a cam edge arranged so that the latch plate pivots to the release position when the cam edge is subjected to a contact force. For example, each latch plate will pivot to its release position upon contact with its respective push bar when the push bar swings from the down-out-of-the-way position to the push position. Once the push bar reaches the push position, the opening in the latch plate is aligned with the push bar and the latch plate automatically swings under the force of gravity to the lock position so that the locking edge engages the push bar, locking the push bar in the push position.

The preferred stretcher also includes a brake-steer butterfly pedal which operates a caster-braking mechanism. The caster-braking mechanism can be moved to a brake position to prevent movement of the stretcher by braking the rotation and swivelling movement of the caster wheels. The casier-braking mechanism can be moved from the brake position to a steer position allowing free movement of the stretcher by permitting rotation and swivelling movement of the caster wheels. A center wheel can be mounted to the stretcher to assist the steering of the stretcher and can be coupled to the brake-steer pedal. The center wheel can be lowered to engage the floor when the brake-steer pedal is moved to the steer position so that the center wheel is deployed and in contact with the floor when the casters are rotating and swivelling. This contact between the center wheel and the floor provides a frictional contact area about which the stretcher can be easily turned.

In addition, the center wheel can be raised off of the floor when the brake-steer pedal is in the brake position so that equipment, such as the base of an overbed table, easily fits under the stretcher. The brake-steer pedal can also be moved to a neutral position at which the casters are free to rotate and swivel and having the center wheel moved to an intermediate position spaced apart from the floor.

The brake-steer pedal is connected to a shaft that extends longitudinally along the length of the stretcher. As the brake-steer pedal is moved between the brake, neutral, and steer positions, the shaft rotates. A linkage assembly connects the shaft to the center wheel. When the brake-steer pedal moves to the brake position, the shaft rotates in a first direction causing the linkage assembly to raise the center wheel off of the floor. When the brake-steer pedal moves to the steer position, the shaft rotates in a second direction causing the linkage assembly to lower the center wheel into contact with the floor.

The stretcher can also include a "single pedal-dual release mechanism" extending outwardly from an elongated side of the stretcher and mounted to a lower frame of the stretcher. The single pedal-dual release mechanism can be used to lower and tilt the patient-support deck. The single pedal-dual release mechanism includes first, second, and third foot pedals, each of which includes an upwardly-facing foot-engaging surface. Depressing the foot-engaging surface of the first foot pedal lowers the head end of the patient-support surface. Likewise, depressing the foot-engaging surface of the second foot pedal lowers the foot end of the patient-support surface.

Depressing the foot-engaging surface of the third foot pedal lowers both the head end and the foot end of the patient-support surface simultaneously.

The preferred stretcher is additionally furnished with a shroud that is carried by the lower frame and that is positioned to lie underneath the patient-support deck. The shroud has a generally upwardly-facing top surface that extends over the first, second, and third pedals and that is formed to include a storage pan. Objects and equipment can be stored and carried by the storage pan.

The shroud also includes a peripheral skirt that projects generally downwardly from a perimeter of the top surface. The skirt defines contoured cavities under the top surface of the shroud and below which portions of the foot-engaging surfaces of the first, second, and third foot pedals are exposed, providing the caregiver with access to the foot-engaging surfaces so that the caregiver can operate the first, second, and third foot pedals when the shroud is installed on the lower frame of the stretcher. Forming the skirt to include the cavities allows for maximizing the size of the storage pan by allowing the storage pan to extend over the foot-engaging surfaces of the pedals while also providing the caregiver with access to the first, second, and third pedals.

It is therefore an object of the present invention to provide a stretcher for transporting a patient along a floor. The stretcher includes an elongated frame, a patient-support deck carried by the frame, and an elongated shaft having a longitudinally-extending axis of rotation. The shaft is coupled to the frame for rotation about the axis of rotation between a first orientation and a second orientation. A wheel is coupled to the shaft for movement relative to the frame between a first position engaging the floor when the shaft is in the first orientation and a second position spaced apart from the floor when the shaft is in the second orientation.

It is another object of the present invention to provide a stretcher for supporting a patient. The stretcher includes an elongated frame having an upper frame and a lower frame having a head end, a foot end, and a first and second elongated side. Drive means are coupled to the upper frame and to the lower frame for supporting the upper frame above the lower frame and for vertically positioning the upper frame relative to the lower frame between an upward raised position and a downward lowered position.

A first pedal including a first foot-engaging surface is pivotably coupled to the first elongated side of the lower frame and extends outwardly therefrom for movement between a lock position and a release position. The first pedal is coupled to the drive means so that the head end of the upper frame moves when the first pedal is moved to the release position. A second pedal including a second foot-engaging surface is pivotably coupled to the first elongated side of the lower frame and extends outwardly therefrom for movement between a lock position and a release position. The second pedal is coupled to the drive means so that the foot end of the upper frame moves when the second pedal is moved to the release position.

A third pedal including a third foot-engaging surface is pivotably coupled to the first elongated side of the lower frame and extends outwardly therefrom for movement between a lock position and a release position. The third pedal is coupled to the drive means so that the head end and the foot end of the upper frame move at generally the same time when the third pedal is moved to the release position. The third foot-engaging surface is spaced apart from and elevated above the first and second foot-engaging surfaces so that a caregiver can engage the third foot-engaging surface without engaging the first and second foot-engaging surfaces.

It is a further object of the present invention to provide a stretcher for supporting a patient. The stretcher includes a lower frame, an upper frame and drive means coupled to the upper frame and to the lower frame for supporting the upper frame above the lower frame for upward and downward movement relative to the lower. frame between an upward raised position and a downward lowered position. A pedal including a generally upwardly-facing foot-engaging surface is coupled to the drive means so that movement of the pedal controls movement of the upper frame relative to the lower frame. A shroud is carried by the lower frame and includes a generally horizontal top wall having a perimetral edge and the pedal and the shroud are arranged having the perimetral edge positioned to lie over the foot-engaging surface so that the top wall of the shroud hangs over the foot-engaging surface of the pedal.

Thus, an improved hospital stretcher is provided having first and second push bars that can be stored below the patient-support deck and underneath the upper frame and that can be individually pivoted upwardly and locked into push positions extending over the patient-support deck by latch plates. The stretcher is also provided with a longitudinally extending brake-steer shaft that controls the caster-braking mechanism and that also controls the mechanism that deploys the center wheel. The brake-steer shaft is rotated by the brake-steer pedal to manipulate the brake-steer mechanism between neutral, brake, and steer positions and to deploy the center wheel into engagement with the floor when the brake-steer mechanism is in the steer position.

The stretcher further includes a single pedal-dual hydraulic release mechanism that extends outwardly from an elongated side of the stretcher and that allows a caregiver to separately lower the head and foot ends of the patient-support surface or to lower the head and foot ends simultaneously by pressing a single pedal.

Finally, the stretcher includes a shroud that maximizes the storage area beneath the patient-support surface by having a top surface that extends above foot pedals that are coupled to the frame and by having a peripheral skirt that defines cavities exposing foot-engaging surfaces of the pedals so that the caregiver can operate the foot pedals when the shroud is installed.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 4 is a perspective view of the first push bar and a latch assembly showing the first push bar in the down-out-of-the-way position and the latch plate of the latch assembly in an upward release position so that the push bar can swing between the push position and the down-out-of-the-way position;

FIG. 5 is a view similar to FIG. 4 showing the first push bar in the push position, the latch plate in a downward lock position, and an edge of the latch plate defining an opening receiving the first push bar, the edge engaging the first push bar locking the first push bar in the push position;

DETAILED DESCRIPTION OF THE DRAWINGS

Figure 1:
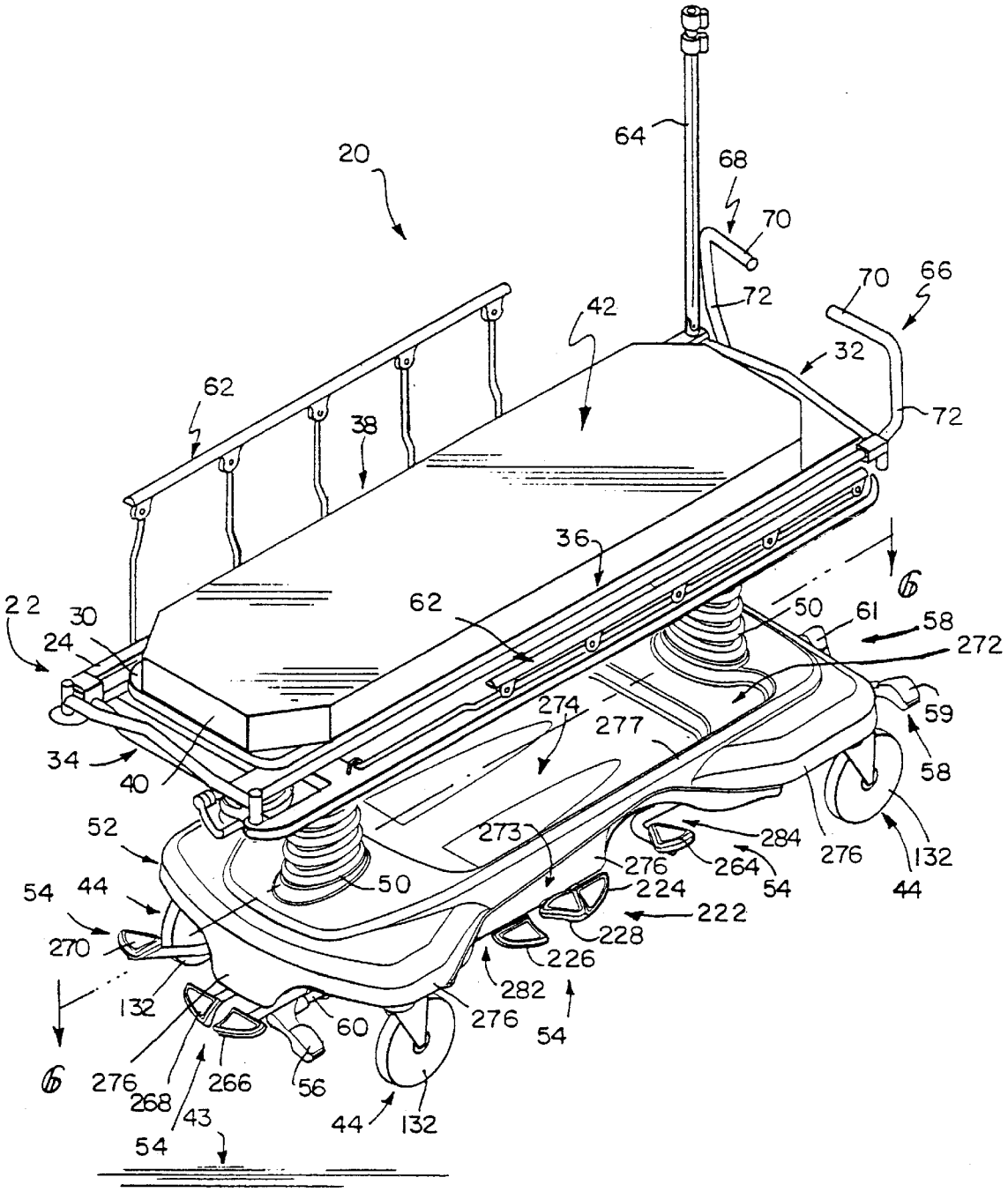
FIG. 1 is a perspective view of a stretcher in accordance with the present invention showing an IV pole extending upwardly above a head end of a patient-support deck, a pair of push bars in a push position having handle posts extending generally horizontally above the head end of the patient-support deck, a brake-steer butterfly pedal located below the push handles, a shroud positioned beneath the patient-support deck and having a top surface formed to include an upwardly-facing storage pan and a downwardly extending skirt appended to the top surface, the skirt defining first and second cavities beneath the top surface, three hydraulic release pedals positioned within the first cavity, and a pump pedal positioned within the second cavity.

A stretcher 20 in accordance with the present invention includes a frame 22 having an upper frame 24, a lower frame 26 covered by a shroud 52, a head end 32, a foot end 34, an elongated first side 36, and an elongated second side 38 as shown in FIG. 1. As used in this description, the phrase "head end 32" will be used to denote the end of any referred-to object that is positioned to lie nearest the head end 32 of stretcher 20 and the phrase "foot end 34" will be used to denote the end of any referred-to object that is positioned to lie nearest the foot end 34 of stretcher 20. Likewise, the phrase "first side 36" will be used to denote the side of any referred-to object that is positioned to lie nearest the first side 36 of stretcher 20 and the phrase "second side 38" will be used to denote the side of any referred-to object that is positioned to lie nearest the second side 38 of stretcher 20.

The upper frame 22 is movably supported above the lower frame 26 by drive means 28 for raising, lowering, and tilting upper frame 22 relative to lower frame 26. In the illustrative embodiment, drive means 28 includes a head end hydraulic cylinder 46 and a foot end hydraulic cylinder 48, shown in FIGS. 6 and 7, which are covered by flexible rubber boots 50 as shown in FIG. 1. Head end hydraulic cylinder 46 controls the vertical position of head end 32 of upper frame 24 relative to lower frame 26 and foot end hydraulic cylinder 48 controls the vertical position of foot end 34 of upper frame 24 relative to lower frame 26. It will be appreciated that various mechanical and electromechanical actuators and drivers may be used to raise and lower the upper frame 24 relative to the lower frame 26 without exceeding the scope of the invention as presently perceived.

It is well known in the hospital bed art that electric drive motors with various types of transmission elements including lead screw drives and various types of mechanical linkages may be used to cause relative movement of portions of hospital beds and stretchers. As a result, the term "drive means" in the specification and in the claims is intended to cover all types of mechanical, electromechanical, hydraulic, and pneumatic mechanisms for raising and lowering portions of stretcher 20, including manual cranking mechanisms of all types, and including combinations thereof such as hydraulic cylinders in combination with electromechanical pumps for pressurizing fluid received by the hydraulic cylinders.

A patient-support deck 30 is carried by upper frame 22 as shown in FIG. 1 and has a head end 32, a foot end 34, a first side 36, and a second side 38. A mattress 40 having an upwardly-facing patient-support surface 42 is supported by the patient-support deck 30.

Illustrative stretcher 20 also includes a pair of collapsible side rails 62 mounted to upper frame 24 adjacent to first and second elongated sides 36, 38 of patient-support deck 30 as shown in FIG. 1. An IV pole 64 for holding solution containers or other objects at a position elevated above patient-support surface 42 is pivotably attached to the upper frame 24 and can be pivoted between a lowered horizontal position alongside the patient-support deck 30 and a generally vertical raised position shown in FIG. 1.

Casters 44 are mounted to lower frame 26 so that the stretcher 20 can be rolled over a floor or other surface across which a patient is being transported, hereinafter referred to as floor 43. Several foot pedals 54 are pivotably coupled to lower frame 26 and are coupled to drive means 28 to control the operation of drive means 28 and thus the vertical movement of head end 32 and foot end 34 of upper frame 24 relative to lower frame 26. In addition, a brake pedal 56 is coupled to lower frame 26 to control braking of the casters 44 and a brake-steer butterfly pedal 58 is coupled to lower frame 26 to control both the braking of casters 44 and the release of braked casters 44. Each of foot pedals 54, brake pedal 56, and brake-steer pedal 58 extends outwardly from lower frame 26.

A shroud 52 covers the lower frame 26 as shown in FIG. 1. Shroud 52 includes a generally horizontal top surface 272 extending over lower frame 26 and over several of foot pedals 54 so that the size of top surface 272 of shroud 52 can be maximized.

In addition, a first push bar 66 is mounted to head end 32 of upper frame 24 adjacent to first. elongated side 36 of the patient-support deck 30 and a second push bar 68 is mounted to head end 32 of upper frame 24 adjacent to second elongated side 38 of patient-support deck 30 as shown in FIG. 1. Each of the first and second push bars 66, 68 is independently movable between a raised push position shown in FIGS. 1—3 (second push bar 68 is in phantom in FIG. 2) and a lowered down-out-of-the-way position shown in FIGS. 2—4 (first push bar 66 is in phantom in FIGS. 2 and 3). Push bars 66, 68 swing from the push position to the down-out-of-the-way position in the direction indicated by arrow 110 shown in FIG. 5, and from the down-out-of-the-way position to the push position in the direction of arrow 118 shown in FIG. 4.

When first and second push bars 66, 68 are in the push position, a caregiver can grip the push bars 66, 68 to maneuver the stretcher 20 over the floor 43.

When the push bars 66, 68 are in the down-out-of-the-way position, push bars 66, 68 are below and out of the way of patient-support surface 42, thus maximizing the caregiver's access to a patient on patient-support surface 42 when the caregiver is positioned adjacent to head end 32 of stretcher 20.

First and second push bars 66, 68 each include a handle post 70 that is grasped by the caregiver when the caregiver moves stretcher 20, a pivot post 74 pivotably coupled to upper frame 24, and a bent extension post 72 connecting handle post 70 to pivot post 74. The respective handle post 70, extension post 72; and pivot post 74 of each push bar 66, 68 are integrally connected in a serpentine-like configuration as shown in FIGS. 2–4.

The pivot post 74 of push bar 66 is pivotably coupled to a pair of spaced-apart flanges 76, shown best in FIG. 4, which receive pivot post 74 therebetween. Flanges 76 are appended to a bracket 78 which is attached to a comer of upper frame 24 adjacent to head end 32 and adjacent to first side 36 of patient-support deck 30 as shown in FIGS. 2–5, and flanges 76 extend downwardly and inwardly therefrom away from first side 36 of upper frame 24. A pivot pin 80 extends between flanges 76 and is received by opposing openings 81 formed in pivot post 74 to rotatably couple the pivot post 74 of push bar 66 to pivot pin 80 and to flanges 76 for pivoting movement of pivot post 74 and push bar 66 relative to flanges 76 about a pivot axis 82 shown in FIGS. 2 and 3 and defined by pivot pin 80 shown in FIG. 4. Push bar 68 is similarly connected to the upper frame 24 but is configured to oppose push bar 66 and to pivot about pivot axis 84 shown in FIG. 2.

Figure 2:
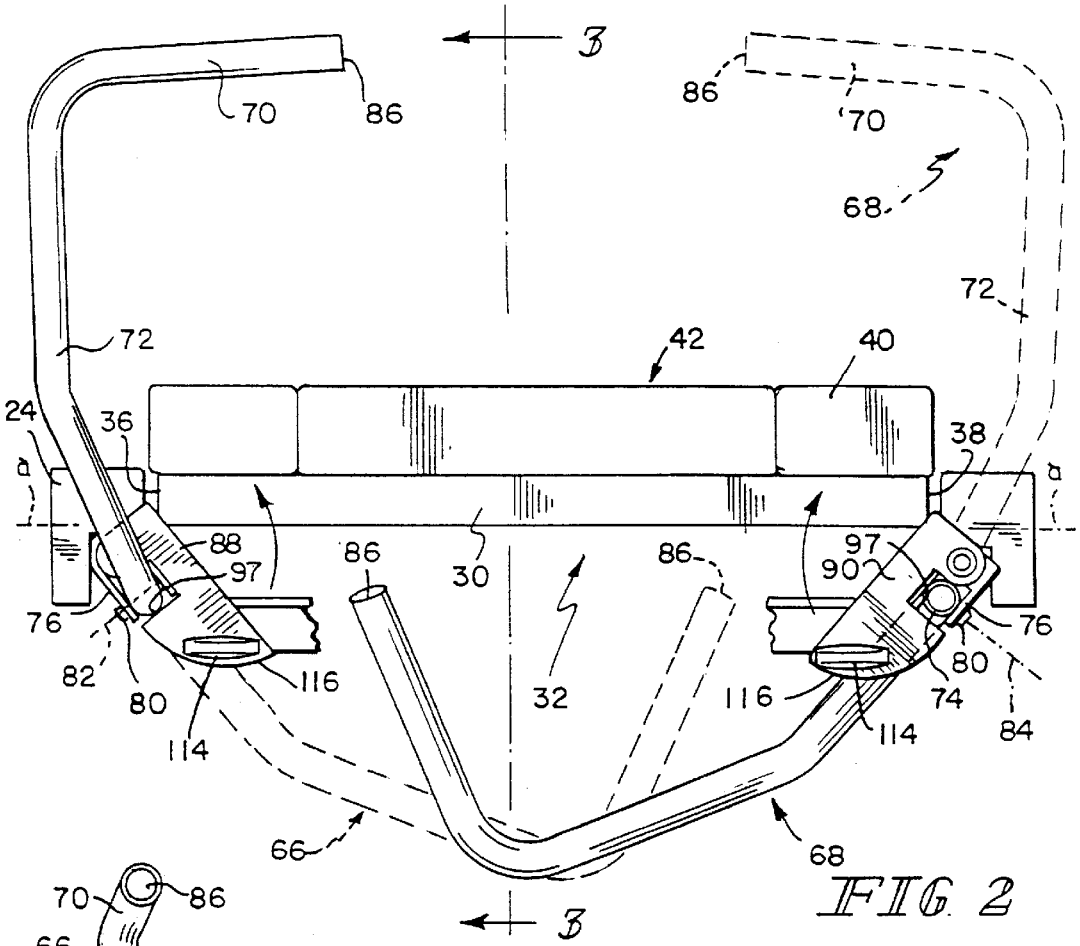
FIG. 2 is an end elevation view of the stretcher of FIG. 1 showing the head end of the patient-support deck, a first push bar pivotably mounted to a frame beneath the patient-support deck and positioned in the upward push position having a handle post extending generally horizontally above a patient-support surface of the patient-support deck, a latch plate locking the first push bar in the push position, a second push bar (in phantom) in the push position opposing the first push bar, the second push bar in a down-out-of-the-way position having a handle post below the patient-support surface, and the first push bar (in phantom) in the down-out-of-the-way position opposing the second push bar.

Each angled pivot axis 82, 84 projects downwardly and outwardly away from first and second sides 36, 38, respectively, of patient-support deck 30 as shown best in FIG. 2. Additionally, each angled pivot axis 82, 84 is positioned to lie in a transverse plane indicated by line c (plane c extends perpendicular to the page in the illustration) as shown best in FIG. 3.

Figure 3:
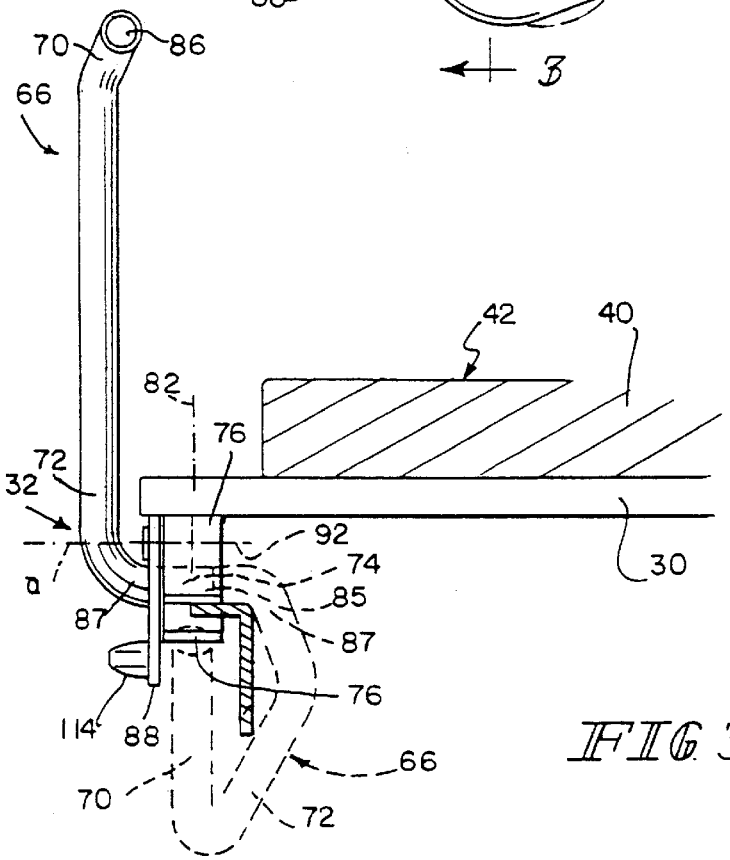
FIG. 3 is a sectional view taken along line 3—3 of FIG. 2 showing the first push bar in the push position having the handle post above the patient-support deck and the first push bar (in phantom) in the down-out-of-the-way position having a portion of the push bar underneath the patient-support deck.

When first and second push bars 66, 68 are in the push position, handle post 70 of each push bar 66, 68 extends above patient-support surface 42 as shown in FIGS. 2 and 3. In the push position, ends 86 of each handle post 70 project inwardly toward one another as shown in FIG. 2. Furthermore, pivot post 74 of push bar 66 extends from a first end 85 coupled to pivot pin 80 to a second end 87 that is integrally appended to extension post 72 at a position outside of head end 32 of upper frame 24 and adjacent to first side 36 of upper frame 24 when push bar 66 is in the push position as shown in FIGS. 3 and 5. Finally, when push bar 66 is in the push position a first portion of extension post 72 angles upwardly from second end 87 of pivot post 74 as shown in FIG. 3 and a second portion of extension post 72 extends generally vertically upwardly from the first portion of extension post 72. The second portion of extension post 72 is integrally appended to handle post 70 above patient-support surface 42. Likewise, pivot post 74, extension post 72, and handle post 70 of push bar 68 are similarly oriented with respect to second elongated side 38 of upper frame 24 and in opposition to push bar 66 when push bar 68 is in the push position.

Each push bar 66, 68 can be independently pivoted about its respective pivot axis 82, 84 from the push position to the down-out-of-the-way position shown in FIGS. 2 and 3 so that push bars 66, 68 are beneath a horizontal plane indicated by line a defined by patient-support deck 30 (plane a extends perpendicular to the page in the illustration). When push bars 66, 68 are in the down-out-of-the-way position, push bars 66, 68 are fully beneath upper frame 24 and pivot post 74 is rotated around so that it extends from first end 85 of pivot post 74 coupled to pivot pin 80 to second end 87 of pivot post 74 generally toward foot end 34 of stretcher 20.

When push bars 66, 68 are in the down-out-of-the-way position, push bars 66, 68 abut one another in a "folded-eyeglass" configuration as shown in FIG. 2 in which ends 86 of the handle posts 70 project generally upwardly and away from each other. When in the folded-eyeglass configuration, either second push bar 68 can be nearer head end 32 than first push bar 66 as shown in FIG. 2 or this arrangement can be reversed so that first push bar 66 is nearer head end 32 than second push bar 68.

Each push bar 66, 68 can be locked in its push position by respective first and second latch plates 88, 90. Each latch plate 88, 90 is pivotably mounted to upper frame 24 adjacent to head end 32 of the patient-support deck 30 as shown in FIGS. 2–5. Latch plate 90 and the operation of latch plate 90 is substantially similar to that of latch plate 88. Thus, the description below of latch plate 88 and the operation of latch plate 88 applies as well to latch plate 90 unless specifically noted otherwise.

Latch plate 88 is mounted to upper frame 24 near side 36 of upper frame 24 for pivoting movement about a longitudinally-extending first latch pivot axis 92 as shown best in FIG. 3. Latch plate 88 can swing about pivot axis 92 between an upward release position away from push bar 66 as shown in FIG. 4 and a downward lock position engaging push bar 66 as shown in FIGS. 2, 3, and 5. Latch plate 88 pivots upwardly about pivot axis 92 in a direction indicated by arrow 112 from the lock position to the release position to release locked push bar 66 so that push bar 66 can swing freely in direction 110 and direction 118 between the push position and the down-out-of-the-way position. In addition, latch plate 88 pivots downwardly under the force of gravity about longitudinal pivot axis 92 in a direction indicated by arrow 100 when latch plate 88 moves from the release position shown in FIG. 4 to the lock position shown in FIGS. 2, 3, and 5.

Latch plate 88 includes a release tab 114 that the caregiver can engage to manually pivot latch plate 88 upwardly from the lock position to the release position. Latch plate 88 is also formed to include an edge 96 defining an opening 98 that receives pivot post 74 of push bar 66 when push bar 66 is in the push position and latch plate 88 is in the downward lock position. Edge 96 includes a locking edge 97 engaging push bar 66 to lock push bar 66 in the push position when latch plate 88 is in the lock position, as shown in FIG. 2.

Edge 96 of latch plate 88 is additionally formed to include a curved cam edge 116 adjacent to opening 98 and locking edge 97. During movement of push bar 66 from the down-out-of-the-way position to the push position in direction 18, pivot post 74 swings in direction 118 to engage cam edge 116 and apply a contact force thereto, pivoting latch plate 88 upwardly to the release position so that opening 98 can receive pivot post 74. Once opening 98 is aligned with pivot post 74 and cam edge 116 no longer engages pivot post 74, latch plate 88 automatically pivots in direction 100 under the force of gravity to the lock position so that locking edge 97 engages push bar 66 to lock push bar 66 in the push position.

A stop tab 120 is fixed to upper frame 24 adjacent to first side 36 of upper frame 24 as shown in FIGS. 4 and 5. Stop tab 120 is received in opening 98 of latch plate 88 to engage edge 96 of latch plate 88 when latch plate 88 is in the lock position and push bar 66 is in the down-out-of-the-way position to stop the downward movement of latch plate 88. Stop tab 120 is positioned to orient cam edge 116 of latch plate 88 to contact pivot post 74 of push bar 66 during movement of push bar 66 from the down-out-of-the-way position to the push position.

Thus, stretcher 20 includes first and second push bars 66, 68 each having a handle post 70 that is positioned for convenient access by a caregiver pushing stretcher 20 when first and second push bars 66, 68 are in the push position as shown in FIG. 1. Latch plates 88, 90 are provided for locking push bars 66, 68 in the push position and each latch plate 88, 90 includes a release tab 114 that the caregiver can engage to rotate latch plates 66, 68 to the upward release position. Rotating latch plates 66, 68 to the release position releases push bars 66, 68 so that push bars 66, 68 can pivot downwardly about angled pivot axes 82, 84 to store below patient-support deck 30 in the down-out-of-the-way position. Push bars 66, 68 can be independently folded downwardly about angled pivot axes 82, 84 to the respective down-out-of-the-way positions to maximize the access of the caregiver to the patient carried on patient-support surface 42 of stretcher 20.

The caregiver can swing each push bar 66, 68 upwardly from the down-out-of-the-way positions to lock each push bar 66, 68 in the push position as shown in FIGS. 1 and 2. For example, when push bar 66 is in the down-out-of-the-way position, stop tab 120 holds latch plate 88 so that cam edge 116 is positioned to lie adjacent to pivot post 74 of push bar 66. As the caregiver swings push bar 66 upwardly from the down-out-of-the-way position in direction 118, pivot post 74 applies a contact force to cam edge 116 of latch plate 88 to automatically pivot latch plate 88 upwardly. Once push bar 66 is in the push position, latch plate 88 automatically drops to the lock position so that locking edge 97 engages push bar 66 to automatically lock push bar 66 in the push position.

Figure 6:
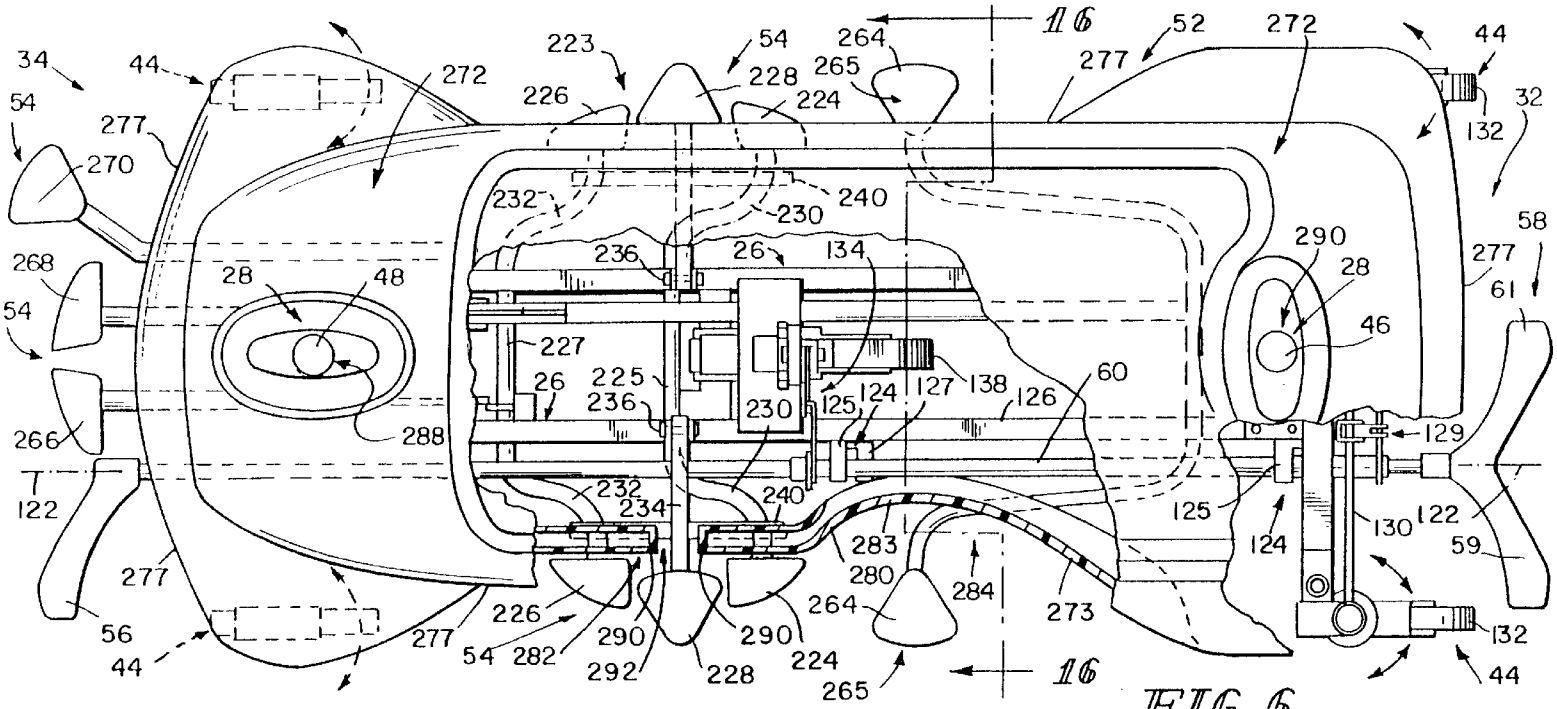
FIG. 6 is a sectional view taken along line 6—6 of FIG. 1 with portions broken away showing the elongated lower frame, movable pedals coupled to the lower frame, a brake-steer mechanism coupled to the lower frame, the brake-steer mechanism including a longitudinally-extending shaft coupled to the casters for controlling the rotational and swivelling movement of the casters and a brake-steer butterfly pedal fixed to the shaft for rotating the shaft when the pedal is depressed by a caregiver, a center wheel movably coupled to the lower frame and coupled to the shaft of the brake-steer mechanism by a linkage assembly, and a shroud carried by the lower frame, the shroud including a top surface having a perimetral edge and a downwardly-extending skirt appended to the edge and defining cavities recessed beneath the top surface, the cavities receiving foot pedals so that at least portions of upwardly-facing foot-engaging surfaces of the foot pedals are positioned beneath the top surface and exposed within the cavities.
Figure 7:
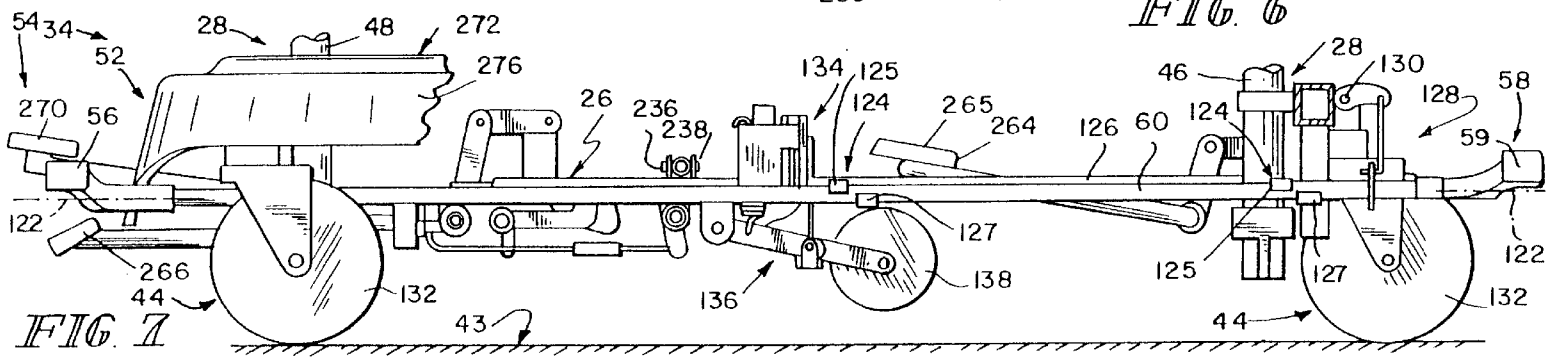
FIG. 7 is a side elevation view of the lower frame and shroud with portions broken away showing the brake-steer pedal in a generally horizontal neutral position and the linkage assembly holding the center wheel in a neutral position spaced apart from the floor.

As previously described, stretcher 20 includes brake pedal 56 positioned at the foot end 34 of stretcher 20 and brake-steer pedal 58 positioned at the head end 32 of stretcher 20 as shown in FIG. 1. A brake-steer shaft 60 extends longitudinally along the length of the stretcher 20 underneath shroud 52 as shown in FIGS. 6 and 7 and is connected to both brake pedal 56 and brake-steer pedal 58. Brake-steer shaft 60 is mounted to lower frame 26 to rotate about a longitudinal pivot axis 122. Movement of either brake pedal 56 or brake-steer pedal 58 by a caregiver causes shaft 60 to rotate about pivot axis 122.

Brake-steer shaft 60 is coupled to lower frame 26 by three sets of flanges 124 as shown in FIG. 6, each set including an upper flange 125 and a lower flange 127 extending outwardly from a lower frame member 126. One set of flanges 124 is located near head end 32 of brake-steer shaft 60, a second set of flanges 124 is located near the middle of brake-steer shaft 60, and a third set of flanges (not shown) is located near foot end 34 of brake-steer shaft 60.

A pair of caster-braking linkages 128 are fixed to brake-steer shaft 60 at positions near head end 32 of brake-steer shaft 60 and foot end 34 of brake-steer shaft 60 as shown in FIGS. 6 and 7. When the brake-steer shaft 60 is in a neutral position, the brake-steer pedal 58 is in a generally horizontal position as shown in FIGS. 6 and 7 and the casters 44 are free to swivel and rotate. The caregiver can depress a braking portion 59 of brake-steer pedal 58 to rotate brake-steer shaft 60 about longitudinal pivot axis 122 in a braking direction indicated by arrow 140 shown in FIG. 8 from the neutral position to a brake position rotating a pair of transverse brake rods 130 that move brake shoes (not shown) into engagement with a wheel 132 of each caster 44. Contact of the brake shoes with wheel 132 of each caster 44 stops rotation and swiveling movement of wheels 132 and casters 44.

When brake-steer shaft 60 is in the brake position, braking portion 59 of brake-steer pedal 58 is angled downwardly toward first side 36 of stretcher 20. From the brake position, the caregiver can depress a steering portion 61 of brake-steer pedal 58 to rotate the brake-steer shaft 60 about longitudinal pivot axis 122 back to the neutral position. When brake-steer shaft 60 is in the neutral position, the caregiver can depress steering portion 61 of brake-steer pedal 58 to rotate brake-steer shaft 60 in a steering direction indicated by arrow 144 shown in FIG. 8 to a steer position having braking portion 59 angled upwardly and steering portion 61 of brake-steer pedal 58 angled downwardly toward second side 38 of stretcher 20.

Figure 8:
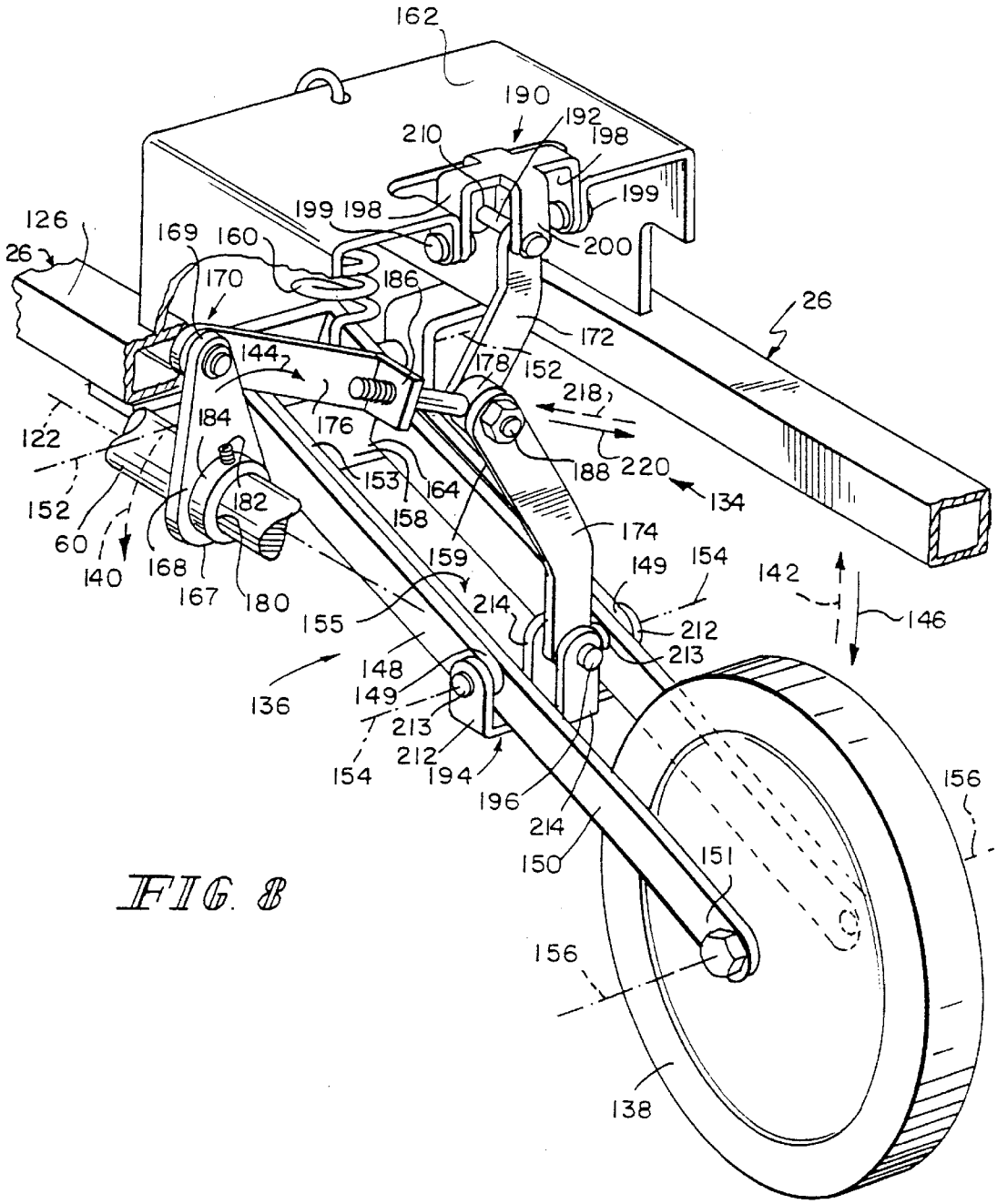
FIG. 8 is an enlarged perspective view of the linkage assembly and the center wheel of FIG. 7 showing the center wheel rotatably coupled to a wheel-mounting bracket and held in the neutral position by the linkage assembly, the linkage assembly including a pivot link fixed to the longitudinal shaft, a connecting link correcting the pivot link to both a frame link that is pivotably coupled to the frame and a bracket link that is pivotably coupled to the wheel-mounting bracket, the connecting link, frame link, and bracket link being coupled to a common pivot pin that translates as the shaft pivots the pivot link.
Figure 9:
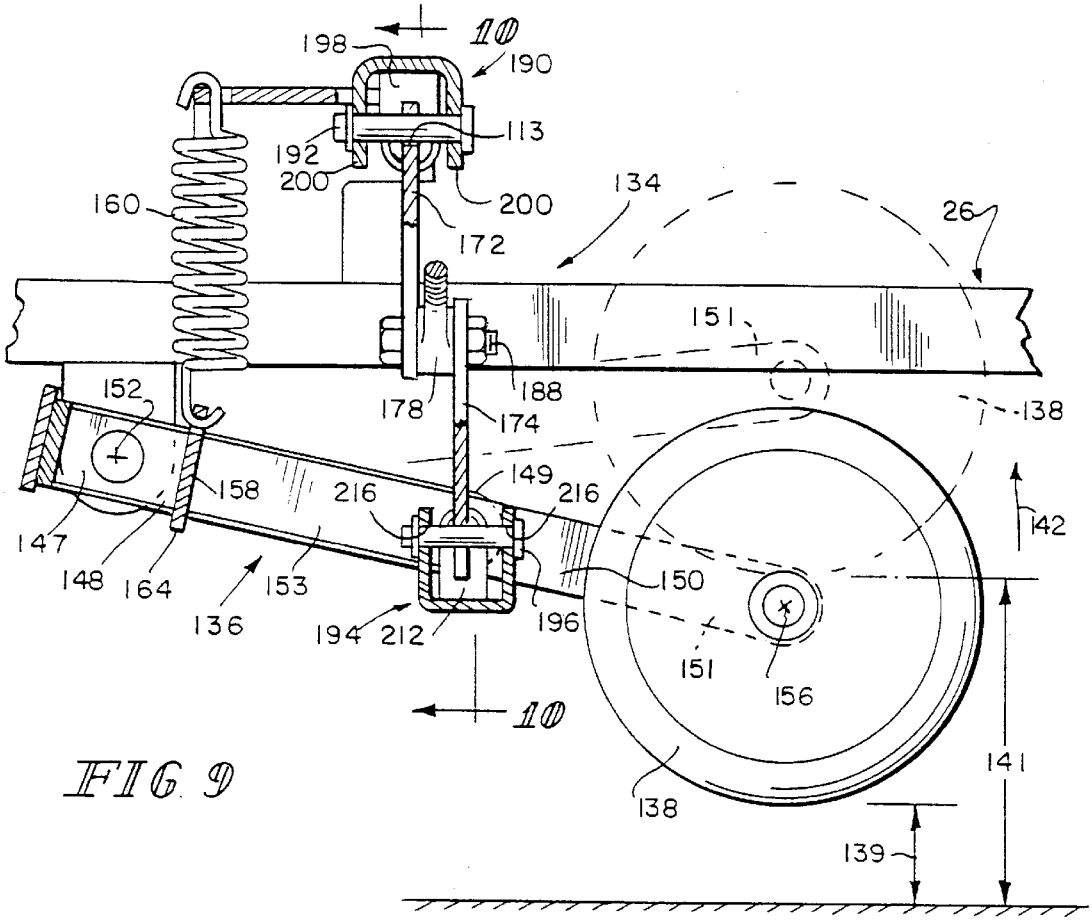
FIG. 9 is a side elevation view of the center wheel and linkage assembly of FIG. 8 showing the center wheel in the neutral position spaced apart from the floor and showing the center wheel (in phantom) and wheel-mounting bracket (in phantom) moved to a brake position by rotation of the shaft (not shown) to the brake position so that the linkage assembly pivots the wheel-mounting bracket upwardly increasing the separation between the center wheel and the floor.

A center wheel 138 is pivotably coupled to lower frame 26 by a wheel-mounting bracket 136 and wheel-mounting bracket 136 is coupled to the brake-steer shaft 60 by linkage assembly 134 as shown in FIGS. 6, 7, and 8. Rotation of brake-steer shaft 60 about axis 122 changes the position of center wheel 138 relative to floor 43. For example, when brake-steer pedal 58 and brake-steer shaft 60 are in the neutral position, as shown in FIGS. 8 and 9, linkage assembly 134 holds wheel-mounting bracket 136 and center wheel 138 off of floor 43 by a slight distance 139. Preferred and illustrative center wheel 138 is spaced apart from the floor 43 by approximately 0.5 inches (1.3 cm) when brake-steer shaft 60 is in the neutral position.

Figure 11:
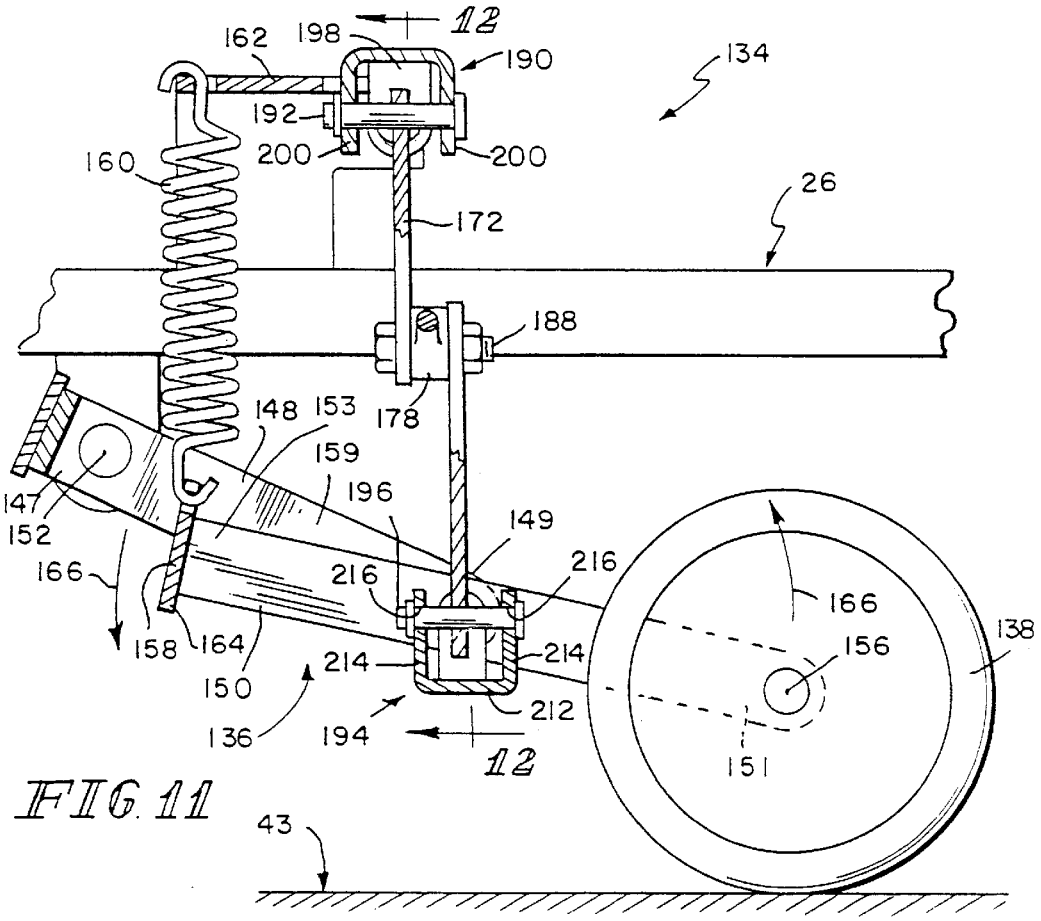
FIG. 11 is a view similar to FIG. 9 showing the center wheel lowered to a steer position engaging the floor and showing a first fork and a second fork of the wheel-mounting bracket in an angled configuration having a spring yieldably biasing the center wheel against the floor.

When the brake-steer shaft 60 rotates in braking direction 140, linkage assembly 134 pivots wheel-mounting bracket 136 upwardly in the direction indicated by arrow 142 in FIGS. 8 and 9 to lift center wheel 138 a second distance 141 from floor 43. Second distance 141 is sufficient to allow equipment such as the base (not shown) of an overbed table (not shown) to be positioned underneath center wheel 138 of stretcher 20. Second distance 141 of preferred and illustrative center wheel 138 is approximately 3.5 inches (8.9 cm). When brake-steer shaft 60 rotates in steering direction 144, linkage assembly 134 pivots wheel-mounting bracket 136 downwardly in the direction indicated by arrow 146 in FIG. 8 to deploy center wheel 138 to the steer position wherein center wheel 138 contacts floor 43 as shown in FIG. 11.

Wheel-mounting bracket 136 includes a first fork 148 and a second fork 150 pivotably coupled to first fork 148. First fork 148 is pivotably coupled at a first end 147 to lower frame 26 for pivoting movement about a first transverse pivot axis 152 as shown in FIGS. 9 and 11. A second end 149 of first fork 148 is pivotably coupled to second fork 150 so that first and second forks 148, 150 can pivot relative to one another about a second transverse pivot axis 154 shown in, FIG. 8.

A head end portion 151 of second fork 150 extends from second transverse pivot axis 154 toward the head end 32 of stretcher 20. Center wheel 138 is mounted to head end portion 151 of second fork 150 for rotation about an axis of rotation 156 as shown in FIG. 8. A foot end portion 153 of second fork 150 extends from second transverse pivot axis 154 toward the foot end 34 of stretcher 20 and is received by a space 155 defined by two spaced-apart prongs 157, 159 of first fork 148. An end plate 158 is fixed to foot end portion 153 of second fork 150 as shown best in FIGS. 8 and 11.

A vertically oriented spring 160 connects end plate 158 of second fork 150 to a frame bracket 162 mounted to lower frame 26 as shown in FIGS. 8–12. When center wheel 138 is in the neutral, brake, and steer positions, spring 160 yieldably biases end plate 158 and foot end portion 153 of second fork 150 upwardly so that head;end portion 151 of second fork 150 and center wheel 138 are yieldably biased downwardly. End plate 158 has a pair of transversely extending barbs 164 that are appended to a lower end of end plate 158 and that are positioned to engage the bottom of first fork 148 when first and second forks 148, 150 are in an "in-line" configuration defining a straight bracket as shown in FIGS. 8 and 9. Thus, barbs 164 stop the upward movement of end plate 158 at the in-line configuration to limit the downward movement of head end portion 151 and center wheel 138 relative to first fork 148 as spring 160 biases end plate 158 of second fork 150 upwardly.

When brake-steer shaft 60 and linkage assembly 134 pivots wheel-mounting bracket 136 downwardly to the steer position deploying center wheel 138, center wheel 138 engages floor 43. Continued downward movement of wheel-mounting bracket 136 pivots second fork 150 relative to first fork 148 about second transverse pivot axis 154 in the direction indicated by arrows 166 in FIG. 11 moving first and second forks 148, 150 into an "angled" configuration as shown in FIG. 11. End plate 158 is yieldably biased upwardly by spring 160 to yieldably bias center wheel 138 downwardly against the floor 43. The upward force provided by spring 160 to foot end portion 153 of second fork 150 and, hence, the downward force biasing head end portion 151 and center wheel 138 against floor 43 should be sufficient to prevent center wheel 138 from sliding sideways when stretcher 20 is turned. Preferred and illustrative spring 160 has a spring force between approximately 36 and 40 pounds-force (160–178 N).

As can be seen, spring 160 biases second fork 150 away from the angled configuration of first and second forks 148, 150 and toward the in-line configuration so that center wheel 138 is biased to a position past the plane of floor 43 and past the plane defined by wheels 132 of casters 44 when center wheel 138 is deployed as shown best in FIG. 11. Of course, floor 43 limits the downward movement of deployed center wheel 138. However, if floor 43 has a surface that is not planar or that is not coincident with the plane defined by wheels 132 of casters 44, spring 160 cooperates with first and second forks 148, 150 to maintain contact between center wheel 138 and floor 43. For example, when illustrative stretcher 20 passes over a threshold of a doorway, the plane defined by the bottoms of wheels 132 of casters 44 is not necessarily coplanar with floor 43. However, spring 160 and first and second forks 148, 150 cooperate to maintain engagement of the deployed center wheel 138 against floor 43.

Illustrative and preferred wheel-mounting bracket 136 can maintain engagement between deployed center wheel 138 and floor 43 when floor 43 beneath center wheel 138 is spaced apart up to approximately 1 inch. (2.5 cm) beneath the plane defined by the bottoms of wheels 132 of casters 44. Additionally, illustrative and preferred wheel-mounting bracket 136 allows deployed center wheel 138 to pass over a threshold that is approximately 1 inch (2.5 cm) above the plane defined by the bottoms of wheels 132 of casters 44 without forcing second pivot axis 154 upwardly relative to lower frame 26 and causing linkage assembly 134 to move out of the steer position into the neutral position.

A frame bracket 162 is mounted to lower frame 26 as shown in FIG. 8. Linkage assembly 134 is connected to frame bracket 162 by a first bent-cross bracket 190 positioned to lie generally above linkage assembly 134 and by an upper pivot pin 192 coupled to first bent-cross bracket 190. In addition, linkage assembly 134 is connected to wheel-mounting bracket 136 by a second bent-cross bracket 194 positioned to lie generally beneath linkage assembly 134 and by a lower pivot pin 196 coupled to second bent-cross bracket 194.

Figure 10:
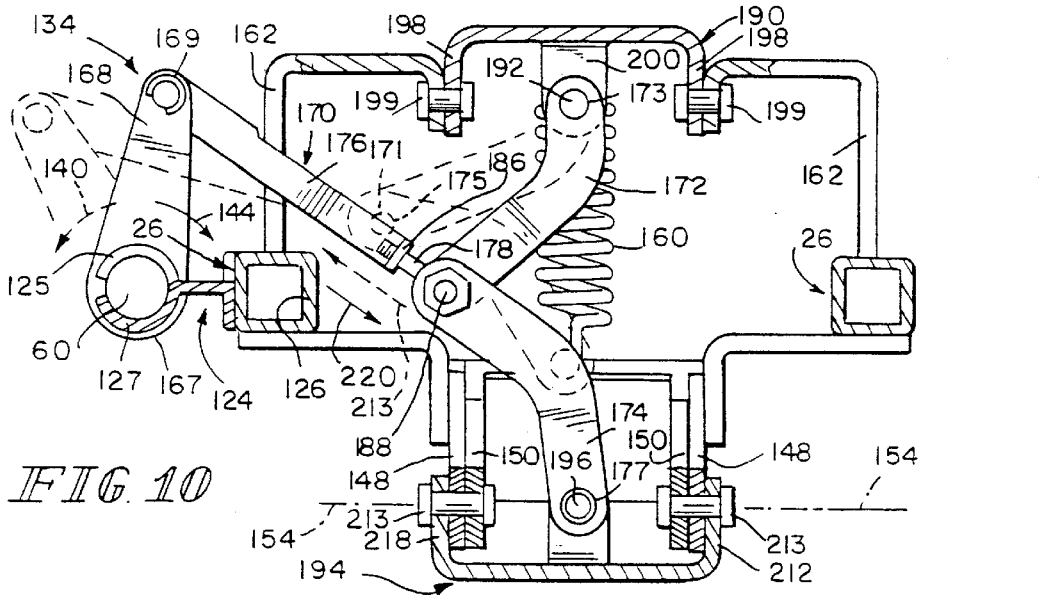
FIG. 10 is a sectional view taken along line 10—10 of FIG. 9 showing the linkage assembly in the neutral position and movable to the brake position (in phantom) so that as the shaft rotates counter-clockwise in the illustration, the pivot link pulls the connecting link and the common pivot pin toward the shaft, closing the "scissors" defined by the frame link and bracket link so that the bracket link pulls the wheel-mounting bracket upwardly.
Figure 12:
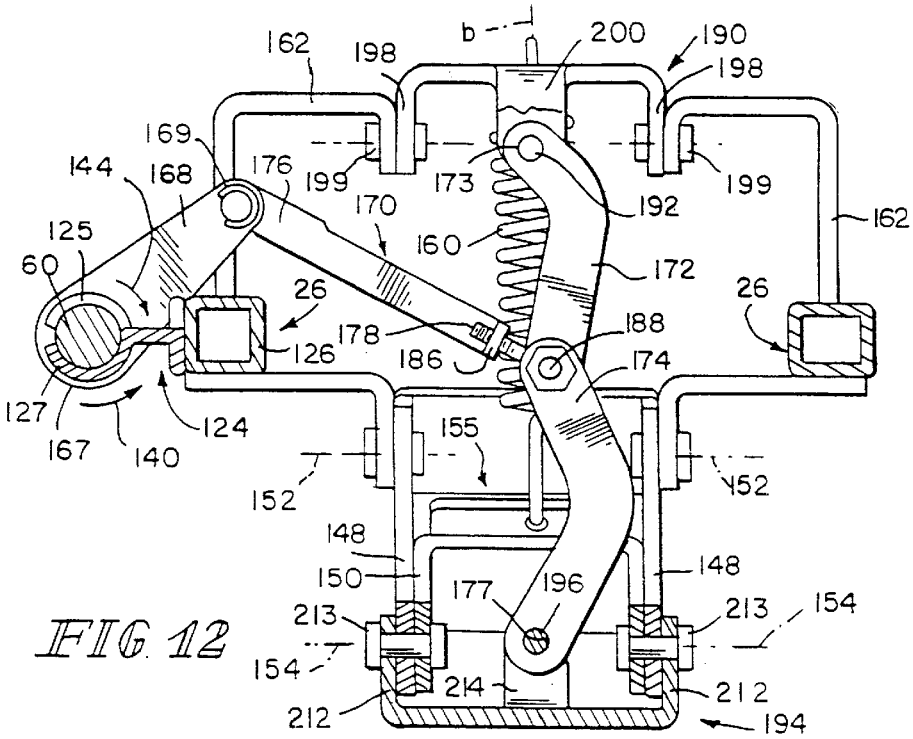
FIG. 12 is a sectional view similar to FIG. 10 taken along line 12—12 of FIG. 11 showing the linkage assembly in the steer position having the pivot link pivoted toward the center wheel thereby opening the scissors defined by the frame link and bracket link, pivoting the wheel-mounting bracket downwardly, and pushing the connecting link and the common pivot pin away from the longitudinal shaft and past the connections of the bracket link to the wheel-mounting bracket and the frame link to the frame to provide the linkage assembly with an "over-center" lock.

Linkage assembly 134 is also connected to brake-steer shaft 60 as shown in FIG. 8. A pivot link 168 of linkage assembly 134 is fixed to brake-steer shaft 60 and a connecting link 170 extends from pivot link 168 to a "common" pivot pin 188. A bracket link 174 extends from common pivot pin 188 to lower pivot pin 196 of second bent-cross bracket 194 and a frame link 172 extends from common pivot pin 188 to upper pivot pin 192 of first bent-cross bracket 190 as shown in FIGS. 8, 10, and 12.

Pivot link 168 includes a first end 167 having an aperture 180 and a collar 184 surrounding aperture 180 and a second end 169 spaced apart from first end 167. Brake-steer shaft 60 extends through aperture 180 of pivot link 168 and a set screw 182 is threaded through collar 184 to fix pivot link 168 to brake-steer shaft 60. As a result, pivot link 168 is fixed to brake-steer shaft 60 and pivots about longitudinal axis 122 when brake-steer shaft 60 rotates about axis 122.

Connecting link 170 includes a link member 176 and an eye bolt 178. Second end 169 of pivot link 168 is pivotably coupled to link member 176 as shown in FIGS. 8, 10, and 12. Link member 176 is formed to include a flange 186 and eye bolt 178 screws into flange 186 to connect eye bolt 178 to link member 176. Eye bolt 178 is formed to include an opening (not shown) that rotatably receives common pivot pin 188.

Frame link 172 is formed to include a first opening 171 rotatably receiving common pivot pin 188 and a second opening 173 spaced apart from first opening 171 and rotatably receiving upper pivot pin 192 of first bent-cross bracket 190 as best shown in FIGS. 9 and 11 so that frame link 172 can pivot relative to common pivot pin 188 and relative to first bent-cross bracket 190. Bracket link 174 is also formed to include a first opening 175 rotatably receiving common pivot pin 188 and a second opening 177 spaced apart from first opening 175 and rotatably receiving lower pivot pin 196 of second bent-cross bracket 194 as shown in FIGS. 8, 9, and 11 so that bracket link 174 can pivot relative to common pivot pin 188 and relative to second bent-cross bracket 194. Thus, connecting link 170, frame link 172, and bracket link 174 are each pivotably connected to common pivot pin 188.

First bent-cross bracket 190 and upper pivot pin 192 are positioned vertically above second bent-cross bracket 194 and lower pivot pin 196 as shown in FIGS. 10 and 12. At common pivot pin 188, eye bolt 178 longitudinally separates frame link 172 and bracket link 174 as shown in FIGS. 9 and 11. To compensate for this separation, first bent-cross bracket 190 is disposed slightly toward foot end 34 of stretcher 20 relative to second bent-cross bracket 194.

First bent-cross bracket 190 includes a pair of downwardly extending side flanges 198 mounted to frame bracket 162 by pivot pins 199. First bent-cross bracket 190 also includes a pair of downwardly extending center flanges 200 each of which is formed to include an aperture 210 through which upper pivot pin 192 extends as shown in FIG. 8. Frame link 172 is coupled to upper pivot pin 192 between downwardly extending center flanges 200 of first bent-cross bracket 190.

Second bent-cross bracket 194 includes a pair of upwardly extending side flanges 212 rotatably mounted to both first and second forks 148, 150 by pivot pins 213 at second transverse pivot axis 154 so that pivot pins 213 define pivot axis 154 of second fork 150 relative to first fork 148. Second bent-cross bracket also includes a pair of upwardly extending center flanges 214 each of which is formed to include an aperture 216 though which the lower pivot pin 196 extends. Bracket link 174 is coupled to lower pivot pin 196 between upwardly extending center flanges 214 of second bent-cross bracket 194.

Frame link 172 and bracket link 174 form a "scissors-like" scissors arrangement as shown in FIG. 10. When the caregiver depresses brake pedal 56 or braking portion 59 of brake-steer pedal 58 and rotates brake-steer shaft 60 about longitudinal pivot axis 122 from the neutral position shown in FIG. 8 in direction 140 toward the brake position shown in FIG. 10, pivot link 168 pivots away from wheel-mounting bracket 136 pulling connecting link 170 and common pivot pin 188 toward brake-steer shaft 60 in the direction indicated by arrow 218. First bent-cross bracket 190 is vertically fixed relative to lower frame 26 and second bent-cross bracket 194 is fixed to wheel-mounting bracket 136 which is fixed in the transverse direction but is pivotably mounted to lower frame 26 for upward and downward pivoting movement relative to lower frame 26. Movement of common pivot pin 188 in direction 218 closes the scissors arrangement formed by frame link 172 and bracket link 174 pulling bracket link 174 upwardly. Pulling bracket link 174 upwardly pivots wheel-mounting bracket 136 in direction 142 and lifts center wheel 138 off of the floor 43.

When the caregiver depresses steering portion 61 of brake-steer pedal 58 and rotates brake-steer shaft 60 about longitudinal pivot axis 122 in direction 144 toward the steer position, pivot link 168 pivots toward wheel-mounting bracket 136 pushing connecting link 170 and common pivot pin 188 away from brake-steer shaft 60 in the direction indicated by arrow 220. Movement of common pivot pin 188 in direction 220 opens the scissors arrangement formed by frame link 172 and bracket link 174 and pushes bracket link 174 downwardly. Pushing bracket link 174 downwardly pivots wheel-mounting bracket 136 in direction 146 thus deploying center wheel 138 into contact with the floor 43.

When brake-steer shaft 60 is in the steer position, pivot link 168 contacts lower frame member 126 as shown in FIG. 12 stopping brake-steer shaft 60 from further rotation in direction 144. When pivot link 168 contacts lower frame member 126, common pivot pin 188 is in an "overcenter position" away from brake-steer shaft 60 and beyond a vertical plane defined by upper and lower pivot pills 192, 196 and indicated by line b (plane b extends perpendicular to the page in the illustration) so that the scissors arrangement formed by frame link 172 and bracket link 174 is in a generally fully-opened position. The upward tension of spring 160 in conjunction with the overcenter position of common pivot pin 188 biases pivot link 168 against lower frame member 126 and biases common pivot pin 188 away from brake-steer shaft 60, thereby "locking" center wheel 138 and brake-steer shaft 60 in the steer position.

Thus, stretcher 20 includes brake pedal 56 and brake-steer pedal 58 connected to longitudinally extending brake-steer shaft 60. Actuation of brake pedal 56 or brake-steer pedal 58 by the caregiver simultaneously controls the position of center wheel 138 and braking of casters 44. Brake-steer pedal 58 has a horizontal neutral position where center wheel 138 is distance 139 above floor 43 and casters 44 are free to rotate and swivel.

From the neutral position, the caregiver can push brake pedal 56 or braking portion 59 of brake-steer pedal 58 down to rotate brake-steer shaft 60 by 30° (degrees) to the brake position to brake casters 44. In addition, when brake-steer shaft 60 rotates to the brake position, pivot link 168 pivots away from wheel-mounting bracket 136 pulling connecting link 170 and common pivot pin 188 in direction 218 and closing the scissors arrangement of frame link 172 and bracket link 174 to lift center wheel 138 distance 141 above floor 43

The caregiver can also push steering portion 61 of brake-steer pedal 58 down to rotate brake-steer shaft 60 by 30° (degrees) past the neutral position to the steer position in which casters 44 are free to rotate and swivel. In addition, when brake-steer shaft 60 rotates to the brake position, pivot link 168 pivots toward the wheel-mounting bracket 136 pushing connecting link 170 and common pivot pin 188 in direction 220 and opening the scissors arrangement of frame link 172 and bracket link 174 to deploy center wheel 138 to engage floor 43 with enough pressure to facilitate steering stretcher 20. In the steer position, second fork 150 of wheel-mounting bracket 136 pivots relative to first fork 148 and relative to lower frame 26. Second fork 150 and center wheel 138, which is mounted to second fork 150, is spring-biased against floor 43 so that stretcher 20 or center wheel 138 can pass over an obstacle such as a 1 inch (2.5 cm) high threshold without disengaging center wheel 138 from floor 43.

As described above, illustrative stretcher 20 also includes foot pedals 54 which control the operation of drive means 28, which illustratively include head end and foot end hydraulic cylinders 46, 48. Foot pedals 54 are coupled to drive means 28 and include pump pedals 264 illustratively located adjacent to each of the first and second sides 36, 38 as shown in FIG. 6 and that the caregiver can pump to raise patient-support surface 42. Each pump pedal 264 is pivotably coupled to lower frame 26 and operatively coupled to both head end hydraulic cylinder 46 and foot end hydraulic cylinder 48. The caregiver can pump either pump pedal 264 to raise patient-support surface 42 relative to lower frame 26 from a lower down position until the desired elevation of patient-support surface 42 is achieved up to an upper raised position.

In addition, foot pedals 54 also include pedals 224, 226, 228, 266, 268 that are pivotably coupled to lower frame 26 along first side 36 and second side 38 of stretcher 20, that extend outwardly therefrom, and that are each operatively coupled to either one or both of head end and foot end hydraulic cylinders 46, 48. Each of pedals 224, 226, 228, 266, 268 can be depressed by the caregiver to lower at least a portion of patient-support surface 42 from the raised position until the desired elevation of patient-support surface 42 is achieved down to the down position.

A first "single-pedal dual release mechanism" 222 is located along first side 36 of stretcher 20 and a second single-pedal dual release mechanism 223 is located along second side 38 of stretcher 20 as shown in FIG. 6. Single pedal-dual release mechanism 222 is described in detail below with respect to FIGS. 13–15. Second single pedal-dual release mechanism 223 is configured and operated in substantially the same way as first single pedal-dual release mechanism 222. Thus, the description below with respect to first single pedal-dual release mechanism 222 of first side 36 of stretcher 20 is also descriptive of second single pedal-dual release mechanism 223 and applies thereto unless otherwise specified.

Figure 13:
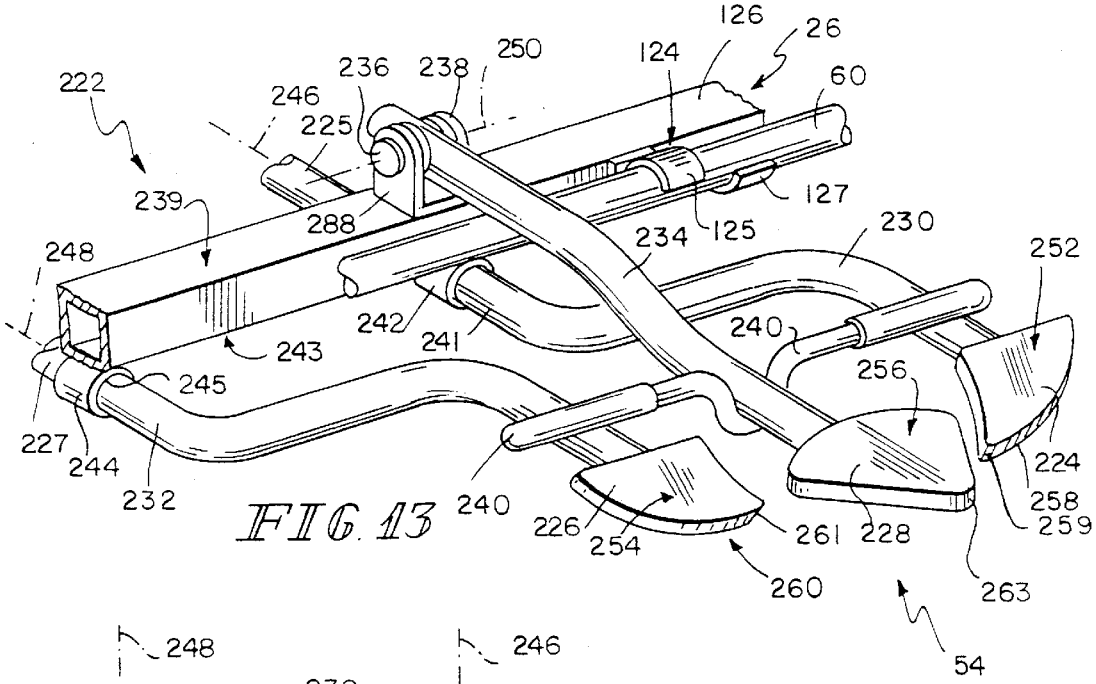
FIG. 13 is an enlarged perspective view of a portion of a "single-pedal dual release mechanism" coupled to side members of the lower frame and extending outwardly therefrom showing first, second, and third pedals pivotably coupled to the lower frame by first, second, and third pedal arms, respectively, each pedal having a foot-engaging surface that can be engaged to selectively depress each of the first, second, and third pedals from an upward lock position to a downward release position, the first pedal arm being coupled to the head end of the patient-support surface so that movement of the first pedal to the release position lowers the head end of the patient-support surface relative to the lower frame, the second pedal arm being coupled to the foot end of the patient-support surface so that movement of the second pedal to the release position lowers the foot end of the patient-support surface relative to the lower frame, and the foot-engaging surface of the third pedal being positioned to lie between the foot-engaging surfaces of the first and second pedals, and a cross bar appended to the third pedal arm and engaging the first and second pedal arms so that when the third pedal moves to the release position, the cross bar pushes the first and second pedal arms downwardly to their respective release positions lowering both the head end and the foot end of the patient-support surface generally simultaneously.

Single-pedal dual release mechanism 222 includes first foot pedal 224 which is attached to a first pedal arm 230, second foot pedal 226 which is attached to a second pedal arm 232, and third foot pedal 228 which is attached to a third pedal arm 234 as shown best in FIG. 13. First pedal arm 230 is pivotably coupled to lower frame 26 and is operatively coupled to head end hydraulic cylinder 46 so that first foot pedal 224 is movable between an upward lock position and a downward release position. Depressing first foot pedal 224 to move first foot pedal to the release position lowers head end 32 of patient-support surface 42 relative to lower frame 26. Likewise, second pedal arm 232 is pivotably coupled to lower frame 26 and is operatively coupled to foot end hydraulic cylinder 48 for movement between an upward lock position and a downward release position so that depressing second foot pedal 226 to move second foot pedal 226 to the release position lowers foot end 34 of patient-support surface 42 relative to lower frame 26.

Third pedal arm 234 is positioned to lie between first and second pedal arms 230, 232 and is pivotably coupled to lower frame 26 for movement between an upward lock position and a downward release position. In preferred embodiments, third pedal arm 234 pivots about a longitudinally-extending pivot pin 236 mounted to a pivot bracket 238 which is fixed to a top surface 239 of lower frame member 126 as shown in FIG. 13.

Figure 14:
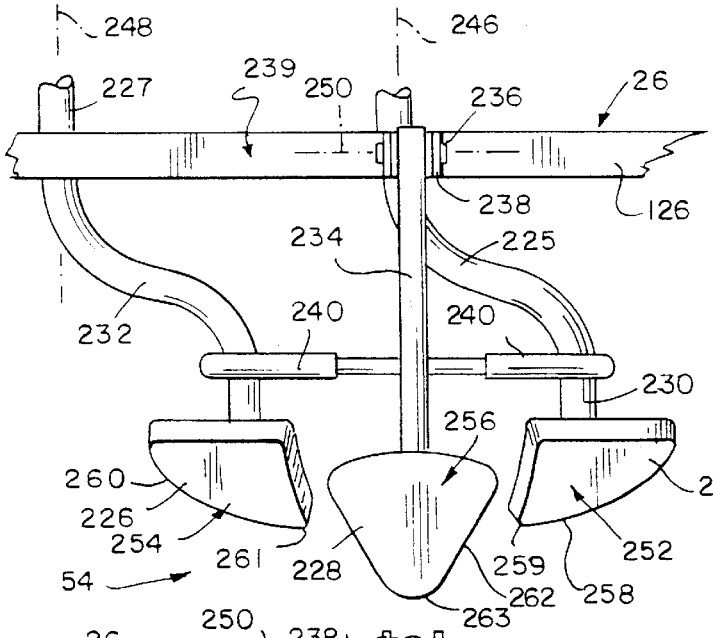
FIG. 14 is a top plan view of the single-pedal dual release mechanism of FIG. 13 showing an outer edge of the foot-engaging surface of the third pedal extending outwardly past outer edges of the foot-engaging surfaces of the first and second pedals so that a user can easily engage the foot-engaging surface of the third pedal without engaging the foot-engaging surfaces of either of the first and second pedals.
Figure 15:
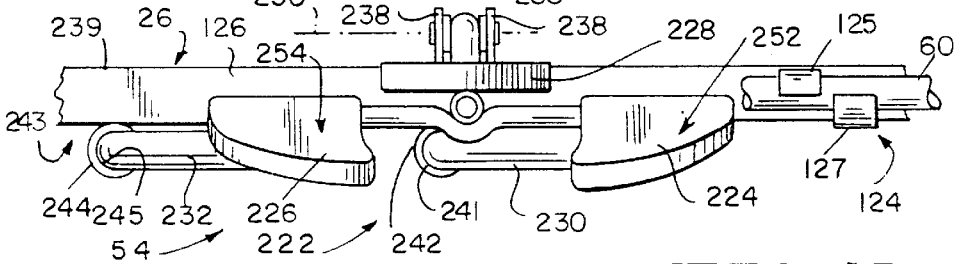
FIG. 15 is a side elevation view of the single-pedal dual release mechanism of FIG. 14 showing the foot-engaging surface of the third pedal positioned to lie above the foot-engaging surfaces of the first and second pedals when each of the first, second, and third pedals are in their respective lock positions so that a user can easily engage the foot-engaging surface of the third pedal without engaging the foot-engaging surfaces of either of the first and second pedals.

A cross bar 240 is appended to third pedal arm 234 and extends longitudinally therefrom toward head end 32 of stretcher 20 and rests upon first pedal arm 230 as shown in FIGS. 13–15. Cross bar 240 also extends longitudinally from third pedal arm 234 toward foot end 34 of stretcher 20 and rests upon second pedal arm 232. When the caregiver depresses third foot pedal 228 to pivot third foot pedal to its release position, cross bar 240 depresses first and second pedal arms 230, 232 and moves pedal arms 230, 232 from their respective lock positions to their respective release positions so that both head end and foot end hydraulic cylinders 46, 48 lower generally simultaneously and at approximately the same rate.

A pedal arm first collar 242 is fixed to a bottom surface 243 of lower frame 26 and is formed to include an opening 241 as shown in FIGS. 13 and 15. First pedal arm 230 is rotatably received by opening 241 so that first pedal 224 is pivotably attached to lower frame 26 by first pedal arm 230 and collar 242. Likewise, a pedal arm second collar 244 is fixed to bottom surface 243 of lower frame 26, is spaced apart from first collar 242, and is formed to include an opening 245. Second pedal arm 232 is rotatably received by opening 245 so that second foot pedal 226 is pivotably attached to lower frame 26 by second pedal arm 232 and collar 244.

First pedal arms 230 of both single pedal-dual release mechanisms 222, 223 are integrally connected to one another as a one-piece first bell crank 225 and as shown in FIG. 6 so that pivoting first foot pedal 224 of first single pedal-dual release mechanism 222 causes first foot pedal 224 of second single pedal-dual release mechanism 223 also to pivot. Similarly, the second pedal arms 232 of both single pedal-dual release mechanisms 222, 223 are integrally connected to one another as a one-piece second bell crank 227.

First collar 242 of first mechanism 222 and first collar 242 of second mechanism 223 cooperate to define a single transverse pivot axis 246 about which first pedal arms 230 pivot as shown in FIGS. 6, 7, and 13. Likewise, second collar 244 of first mechanism 222 and second collar of 244 of second mechanism 223 cooperate to define a single transverse pivot axis 248 about which second pedal arms 232 pivot. In contrast, pivot pin 236 defines a longitudinal pivot axis 250 about which third pedal arm 234 pivots. Although illustrative and preferred third pedal arm 234 pivots about longitudinally-extending pivot axis 250 defined by pivot pin 236, it is within the scope of the invention as presently perceived to provide a third pedal arm that pivots about a pivot axis that extends in a direction other than the longitudinal direction so long as the third pedal arm interacts with first and second pedal arms 230, 232 as described above. For example, the third pedal arm could be a bent "bell crank-shaped" arm mounted to a collar fixed to bottom surface 243 of lower frame 26 so that the third pedal arm pivots about a transversely-extending pivot axis, without exceeding the scope of the invention as presently perceived.

Figure 16:
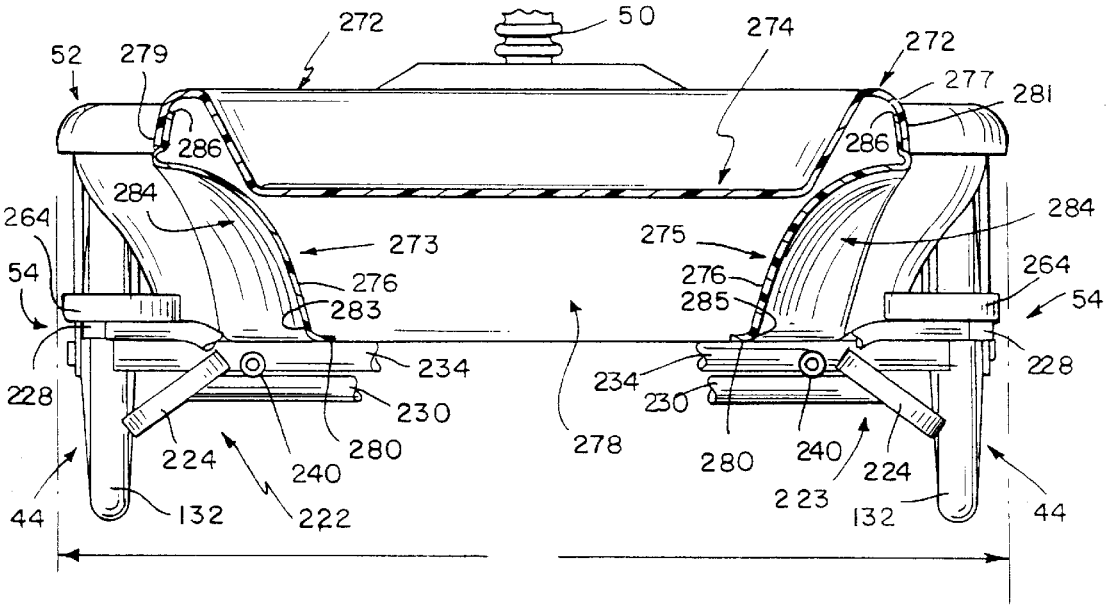
FIG. 16 is a sectional view taken along line 16—16 of FIG. 6 showing the top surface of the shroud projecting above the foot-engaging surfaces of each of the pedals mounted along sides of the lower frame, the pedals being received by cavities defined by the downwardly and inwardly extending skirt of the shroud positioned underneath the top surface of the shroud so that the foot-engaging surfaces of the pedals are exposed and are available to the caregiver when the shroud is installed on the stretcher.

First foot pedal 224 has a first foot-engaging surface 252, second foot pedal 226 has a second foot-engaging surface 254, and third foot pedal 228 has a third foot-engaging surface 256 as shown in FIGS. 13–16. Foot-engaging surfaces 252, 254, 256 arc configured to allow the caregiver to selectively step on a desired one of foot-engaging surfaces 252, 254, 256 without stepping on the other foot-engaging surfaces. For example, both first and second foot-engaging surfaces 252, 254 are angled downwardly and outwardly away from lower frame 26 as shown in FIGS. 15 and 16, whereas third foot-engaging surface 256 is a generally horizontal upwardly-facing surface. Additionally, third foot-engaging surface 256 is positioned to lie in an elevated position above first and second foot-engaging surfaces 252, 254 as shown in FIGS. 15 and 16.

First foot pedal 224 has a first outer edge 258, second foot pedal 226 has a second outer edge 260, and third foot pedal 228 has a third outer edge 262 as shown in FIG. 13. An extreme outer portion 263 of third outer edge 262 of third foot pedal 228 extends to a position that is further away from lower frame 26 than extreme outer portions 259, 261 of first and second outer edges 258, 260, respectively, of first and second foot pedals 224, 226 as shown in FIG. 14. The positioning of first, second, and third outer edges 258, 260, 262 in this manner also aids the caregiver in engaging only the desired foot-engaging surface.

In use, when the caregiver depresses first foot pedal 224 and moves first-foot pedal 224 to the release position, first pedal arm 230 rotates about transversely-extending pivot axis 246 to actuate a release portion (not shown) of illustrative head end hydraulic cylinder 46, lowering head end 32 of patient-support surface 42. When the caregiver depresses second foot pedal 226 and moves second foot pedal 226 to the release position, second pedal arm 232 rotates about transversely-extending pivot axis 248 to actuate a release portion (not shown) of illustrative foot end hydraulic cylinder 48, lowering foot end 34 of patient-support surface 42. When the caregiver depresses third foot pedal 228 and moves third foot pedal 228 to the release position, cross bar 240 engages first and second pedal arms 230, 232 so that both pedal arms 230, 232 rotate downwardly about their respective transversely-extending pivot axes 246, 248 and reach their respective release positions at generally the same time. Thus, the caregiver can lower head end 32 and foot end 34 of patient-support surface 42 together or separately by selectively depressing third foot pedal 228 to lower head end 32 and foot end 34 of patient-support surface 42 together, or separately depressing one of first and second foot pedals 224, 226 of single-pedal dual hydraulic release mechanisms 222, 223 to separately lower head end 32 or foot end 34, respectively.

As described above, stretcher 20 includes two single pedal-dual release mechanisms 222, 223 that allow the caregiver to evenly lower head end 32 and foot end 34 of patient-support surface 42. Each single pedal-dual hydraulic release mechanism 222, 223 includes first pedal 224 which lowers head end 32 of patient-support surface 42, second pedal 226 which lowers foot end 34 of patient-support surface 42, and third pedal 228 positioned between first and second pedals 226, 228. First, second, and third pedals 224, 226, 228 are attached at ends of first, second, and third pedal arms 230, 232, 234. Pedal arms 230, 232, 234 are pivotably coupled to lower frame 26 and first and second pedal arms 230, 232 pivot about transversely-extending pivot axes 246, 248. First pedal arm 230 is spaced apart from second pedal arm 232 and third pedal arm 234 is positioned to lie therebetween. Cross bar 240 is appended to third pedal arm 234 and rests on first and second pedal arms 230, 232 to hold third pedal 228 above first and second pedals 224, 226.

Rather than sequentially depressing first foot pedal 224 and then second foot pedal 226, second foot pedal 226 and then first foot pedal 224, or attempting to simultaneously engage and depress both first and second foot pedals 224, 226 to lower both head and foot ends 32, 34 of patient-support surface 42, the caregiver, while standing along either first side 36 or second side 38 of stretcher 20 can depress third pedal 228 so that cross bar 240 lowers first and second pedal arms 230, 232 which, in turn, releases drive means 28 of both head end 32 and foot end 34 of stretcher 20 at the same time to evenly lower patient-support surface 42. However, if desired, the caregiver can depress first pedal 224 to lower only head end 32 of patient-support surface 42 or the caregiver can depress second pedal 226 to lower only foot end 34 of patient-support surface 42.

In addition, stretcher 20 has a redundant first lowering pedal 266, a redundant second lowering pedal 268, and a redundant pump pedal 270 all of which are positioned at foot end 34 of stretcher 20 as shown in FIGS. 1 and 6. First lowering pedal 266 is pivotably coupled to lower frame 26 and is illustratively operatively coupled to head end hydraulic cylinder 46 for lowering head end 32 of patient-support surface 42. Second lowering pedal 268 is pivotably coupled to lower frame 26 and is illustratively operatively coupled to foot end hydraulic cylinder 48 for lowering foot end 34 of patient-support surface 42. Pump pedal 270 is pivotably coupled to lower frame 26 and is illustratively operatively coupled to both head and foot end hydraulic cylinders 46, 48 for raising patient-support surface 42.

Stretcher 20 is outfitted with a shroud 52 covering lower frame 26 and any components attached to lower frame 26 including casters 44, center wheel 138, brake-steer shaft 60, caster-braking linkages 128, transverse brake rods 130, linkage assembly 134, and wheel-mounting bracket 136 as shown in FIGS. 1, 6, and 16. Shroud 52 has a top surface 272 formed to include a storage pan 274. Objects (not shown) can be placed in storage pan 274 and carried by stretcher 20.

Top surface 272 of shroud 52 extends laterally over portions of first, second, third, and pump pedals 224, 226, 228, 264 to a perimetral edge 277 of top surface 272 as shown in FIG. 6. The extension of top surface 272 over portions of first,. second, third, and pump pedals 224, 226, 228, 264 allows the size of top surface 272 and the size of a storage pan 274 formed in top surface 272 to be maximized. A peripheral skirt 276 extends generally downwardly from perimetral edge 277 to a lowermost bottom edge 280 of shroud 52 which is positioned below at least portions of pedals 224, 226, 228, 264 so that portions of peripheral skirt 276 are positioned to lie behind pedals 224, 226, 228, 264. Peripheral skirt 276 and top surface 272 cooperate to define an interior region 278 as shown in FIG. 16.

Perimetral edge 277 includes first and second spaced-apart straight side portions 279, 281 as shown in FIGS. 6 and 16. In addition, bottom edge 280 includes first and second spaced-apart side portions 283, 285. In preferred embodiments, side portions 283, 285 of bottom edge 280 are "sickle-shaped" as shown in FIG. 6 Peripheral skirt 276 includes first and second sides 273, 275 extending respectively between side portions 279, 281 of perimetral edge 277 and side portions 283, 285 of bottom edge 280. Each side 273, 275 of peripheral skirt 276 is formed to define a first cavity 282 and a second cavity 284 as shown in FIG. 16. Second cavity 284 is adjacent to first cavity 282 and both cavities 282, 284 are separated from interior region 278 by peripheral skirt 276.

First cavities 282 are each positioned to lie underneath top surface 272 and above portions of first, second, and third pedals 224, 226, 228 of single-pedal dual hydraulic release mechanisms 222, 223 so that foot-engaging surfaces 252, 254, 256 of foot pedals 224, 226, 228, respectively, are exposed within first cavity 282. The portions of peripheral skirt 276 forming first cavities 282 are recessed sufficiently beneath top surface 272 to accommodate a caregiver's foot allowing the caregiver to depress first, second, and third pedals 224, 226, 228.

First, second, and third pedal arms 230, 232, 234 extend outwardly from underneath bottom edge 280 of shroud 52 so that portions of first, second, and third pedals 224, 226, 228 are positioned underneath the portion of peripheral skirt 276 defining first cavity 282 as shown in FIGS. 6 and 16. First and second pedal arms 230, 232 of preferred illustrative stretcher 20 are each biased into the upward lock position by head end and foot end hydraulic cylinders 46, 48, respectively, and cross bar 240 rests on first and second pedal arms 230, 232 thus positioning third pedal arm 234 in the upward lock position. A notch 292 is formed in bottom edge 280 of peripheral skirt 276 to accommodate an tipper portion of third pedal arm 234 which is raised above cross bar 240.

Second cavities 284 are each positioned to lie above a portion of pump pedals 264 so that foot-engaging surfaces 265 of pump pedals 264 are exposed within second cavities 284. Each second cavity 284 is "deeper" than each first cavity 282, the portion of bottom edge 280 defining each second cavity 284 extending further under top surface 272 than the portion of bottom edge 280 defining each first cavity 282, so that sufficient room is provided for the caregiver's foot during pumping motion of pump pedal 264 by the caregiver. In the illustrative and preferred embodiment, peripheral skirt 276 is appended to perimetral edge 277 of top surface 272 by sonically welding first and second sides 273, 275 of peripheral skirt 276 to top surface 272 along a longitudinally-extending overlapping joint 286 shown in FIG. 16.

Shroud 52 is additionally formed to include an oval-shaped head end aperture 288 having a transversely extending major axis and an oval-shaped foot end aperture 290 having a longitudinally extending major axis as shown in FIG. 6. Head end hydraulic cylinder 46 extends upwardly through head end aperture 288 and foot end hydraulic cylinder 48 extends upwardly through foot end aperture 290. Brake-steer pedal 58, brake pedal 56, redundant first pedal 266, redundant second pedal 268, and redundant pump pedal 270 each extends outwardly past ends 32, 34 of perimetral edge 277 of top surface 272 and past ends 32, 34 of bottom edge 280 as also shown in FIG. 6.

Thus, stretcher 20 includes a shroud 52 having a top surface 272 that laterally extends over portions of first, second, third, and pump pedals 224, 226, 228, 264 maximizing the size of top surface 272 and storage pan 274. Peripheral skirt 276 includes sides 273, 275 that extend downwardly from perimetral edge 277 of top surface 272 and that are each formed to define first and second cavities 282, 284. First and second cavities 282, 284 provide the caregiver with access to foot-engaging surfaces 252, 254, 256, 265 of first, second, third, and pump pedals 224, 226, 228, 264 which are positioned to lie within cavities 282, 284 and underneath sides 273, 275 of peripheral skirt 276. Providing cavities 282, 284 thus allows the storage pan 274 to extend over portions of foot-engaging surfaces 252, 254, 256, 265 while still allowing the caregiver to have access to foot-engaging surfaces 252, 254, 256, 265.

Although the invention has been described in detail with reference to a certain preferred embodiment, variations and modifications exist within the scope and spirit of the invention as described and as defined in the following claims.

What is claimed is:

1. A stretcher for transporting a patient along a floor, the stretcher comprising an elongated frame, a plurality of casters coupled to the frame and engaging the floor, a patient-support deck carried by the frame, an elongated shaft coupled to the frame for rotation about a longitudinally-extending axis, a wheel, a bracket coupled to the wheel and to the frame, the bracket being movable between a first position in which the wheel engages the floor and a second position in which the wheel is spaced apart from the floor, and a linkage pivotably coupled to the frame and to the bracket, the linkage also being coupled to the shaft so that rotation of the shaft about the axis actuates the linkage to move the bracket between the first and second positions, wherein the linkage includes a first link coupled to the shaft to rotate therewith about the axis, a second link pivotably coupled to the first link, a third link pivotably coupled to the second link and pivotably coupled to the frame, and a fourth link pivotably coupled to the second link and pivotably coupled to the bracket.

2. The stretcher of claim 1, wherein the linkage includes a pivot pin to which the second, third, and fourth links are each coupled.

3. The stretcher of claim 2, wherein the pivot pin extends in parallel relation with the axis.

4. The stretcher of claim 2, wherein the third link is pivotably coupled to the frame at a first point, the fourth link is pivotably coupled to the bracket at a second point, the first and second points both lying on a vertical plane, and the pivot pin passing through the vertical plane when the bracket moves between the first and second positions.

5. The stretcher of claim 1, wherein the third and fourth links move from a folded position to an overcenter position when the bracket moves from the second position to the first position.

6. The stretcher of claim 1, wherein the frame includes a longitudinally extending frame member, the first link engages the frame member when the bracket is in the first position, and the first link is spaced apart from the frame member when the bracket is in the second position.

7. The stretcher of claim 1, further comprising a shroud covering the frame and covering the linkage, the shroud also covering a majority of the elongated shaft, the shroud including a head end and a foot end, the elongated shaft including a first portion extending out from under the head end of the shroud, the elongated shaft including a second portion extending out from under the foot end of the shroud, a first foot pedal coupled to the first portion of the elongated shaft, the first foot pedal being engagable to rotate the elongated shaft, a second foot pedal coupled to the second portion of the elongated shaft, and the second foot pedal being engagable to rotate the elongated shaft.

8. A stretcher for transporting a patient along a floor, the stretcher comprising an elongated frame, a plurality of casters coupled to the frame and engaging the floor, a patient-support deck carried by the frame, an elongated shaft coupled to the frame for rotation about a longitudinally-extending axis, a wheel, a bracket coupled to the wheel and to the frame, the bracket being movable between a first position in which the wheel engages the floor and a second position in which the wheel is spaced apart from the floor, and a linkage pivotably coupled to the frame and to the bracket, the linkage also being coupled to the shaft so that rotation of the shaft about the axis actuates the linkage to move the bracket between the first and second positions, wherein the frame includes a longitudinally extending frame member, the frame includes a set of flanges extending transversely from the frame member, and the elongated shaft is supported for rotation alongside the frame member by the set of flanges.

9. A stretcher for transporting a patient along a floor, the stretcher comprising an elongated frame, a plurality of casters coupled to the frame and engaging the floor, a patient-support deck carried by the frame, an elongated shaft coupled to the frame for rotation about a longitudinally-extending axis, a wheel, a bracket coupled to the wheel and to the frame, the bracket being movable between a first position in which the wheel engages the floor and a second position in which the wheel is spaced apart from the floor, and a linkage pivotably coupled to the frame and to the bracket, the linkage also being coupled to the shaft so that rotation of the shaft about the axis actuates the linkage to move the bracket between the first and second positions, wherein the bracket includes a first fork coupled to the frame and a second fork coupled to the first fork, the second fork is pivotable relative to the first fork, and the wheel is coupled to the second fork.

10. The stretcher of claim 9, further comprising a spring coupled to the second fork and coupled to the frame to provide shock absorption between the second fork and the frame when the wheel engages the floor.

* * * * *

UNITED STATES PATENT AND TRADEMARK OFFICE

CERTIFICATE OF CORRECTION

PATENT NO. : 6,505,359 B2
DATED : January 14, 2003
INVENTOR(S) : Heimbrock et al.

It is certified that error appears in the above-identified patent and that said Letters Patent is hereby corrected as shown below:

Title page,
Item [75], Inventors, delete "Joanthan T. Turner" and insert
-- Jonathan D. Turner --.

Signed and Sealed this

Thirteenth Day of April, 2004

JON W. DUDAS
*Acting Director of the United States Patent and Trademark Office*